US005907113A

United States Patent [19]

Hebestreit et al.

[11] Patent Number: 5,907,113

[45] Date of Patent: May 25, 1999

[54] STRINGS FOR MUSICAL INSTRUMENTS

[75] Inventors: Charles G. Hebestreit, Flagstaff; David J. Myers, Camp Verde, both of Ariz.

[73] Assignee: W. L. Gore & Associates, Inc., Newark, Del.

[21] Appl. No.: 08/772,664

[22] Filed: Dec. 20, 1996

Related U.S. Application Data

[63] Continuation-in-part of application No. 08/630,416, Apr. 3, 1996, Pat. No. 5,801,319, which is a continuation-in-part of application No. 08/561,774, Nov. 22, 1995.

[51] Int. Cl.[6] ..... G10D 3/10

[52] U.S. Cl. ..... 84/297 R; 84/199; 84/297 S

[58] Field of Search ..... 84/199, 297 S, 84/297 R

[56] References Cited

U.S. PATENT DOCUMENTS

| | | | |
|---|---|---|---|
| 3,826,171 | 7/1974 | Kaar | 84/297 S |
| 3,953,566 | 4/1976 | Gore | 264/288 |
| 3,962,153 | 6/1976 | Gore | 260/2.5 R |
| 4,063,674 | 12/1977 | Stone et al. | 228/173 E |
| 4,096,227 | 6/1978 | Gore | 264/210 R |
| 4,187,390 | 2/1980 | Gore | 174/102 R |
| 4,326,444 | 4/1982 | Markley | 84/297 |
| 4,339,499 | 7/1982 | Tappe et al. | 428/373 |
| 4,382,358 | 5/1983 | Tappe et al. | 57/243 |
| 4,539,228 | 9/1985 | Lazarus | 427/180 |
| 5,107,852 | 4/1992 | Davidson et al. | 128/772 |
| 5,535,658 | 7/1996 | Kalosdian | 84/297 |
| 5,610,348 | 3/1997 | Aladin | 84/297 |

FOREIGN PATENT DOCUMENTS

| | | |
|---|---|---|
| 963830 | 5/1957 | Germany . |
| 3133231 | 3/1983 | Germany . |
| 3326006 | 1/1985 | Germany . |
| 4109334 A1 | 11/1992 | Germany . |
| 63-182441 | 7/1988 | Japan . |
| 63-057799 | 11/1988 | Japan . |
| 690031 | 4/1953 | United Kingdom . |
| 2187217 | 9/1987 | United Kingdom . |
| 9001766 | 2/1990 | WIPO . |

OTHER PUBLICATIONS

Catalog: "Kaman Reference Manual & Music Products Catalog," Kaman Music Corporation 1994 pp. 67, 78.

Fleishman, H. Gauging Strings: How to get the most out of today's steel and nylon strings. Acoustic Guitar Oct. 1996; pp. 65–73.

*Primary Examiner*—William M. Shoop, Jr.
*Assistant Examiner*—Marlon T. Fletcher
*Attorney, Agent, or Firm*—David J. Johns

[57] ABSTRACT

An improved musical instrument string is provided. The string includes a polymer cover that protects the string, from contamination while maintaining the original "lively" sound of the musical string. By supplying the cover over a conventional string and preferable over a conventional wound string, the string is protected against contamination while also making the string easier to play. The preferred cover comprises at least one layer of expanded polytetrafluoroethylene (ePTFE) that is most preferably sealed with a polymer coating. In particularly preferred embodiments, a cover is applied over a portion of the length of the string having a relatively reduced variable mass. The result is that the string has relatively uniform mass along its entire length thereby assuring correct intonation.

19 Claims, 14 Drawing Sheets

STRINGS FOR MUSICAL INSTRUMENTS

RELATED APPLICATIONS

The present application is a Continuation-in-Part of U.S. patent application Ser. No. 08/630,416 filed Apr. 3, 1996, now U.S. Pat. No. 5,801,319, which is a Continuation-in-Part of Ser. No. 08/561,774 filed Nov. 22, 1995.

BACKGROUND OF THE INVENTION

1. Field of the Invention

The present invention relates to strings for musical instruments, and particularly to strings for musical instruments such as strings for guitars and the like that may be manipulated along their length.

2. Description of Related Art

There are a multitude of different types of musical strings employed today, each performing a different function. A typical guitar employs a straight (non-wound) string (such as "catgut," metal, or synthetic polymer (e.g., those disclosed in U.S. Pat. Nos. 4,339,499 and 4,382,358)) for higher pitched notes, and wound metal or polymer strings (usually a wrapped metal or polymer winding over a core of nylon or similar material) for lower pitch notes. Wound strings rely on the additional string mass per unit length supplied by the spiral wrap of the wound string to supply lower pitched notes at an acceptable string tension. Existing string designs have been refined over many years to provide excellent musical tones, but the strings continue to be limited in many respects.

There is a large variety of stringed musical instruments employed today that require human contact along at least a portion of the strings, such as in the fingering and plucking of guitar strings in order to be played. While straight gage strings can be easily wiped of dirt and oil after use, wound strings tend to become contaminated with dirt, skin oils, and perspiration after even a few hours of playing. It is believed that dirt and other contaminants infiltrate windings of the string causing the windings to have limited motion. After a relatively short period of time, a typical wound string will become musically "dead," apparently due to the build-up of this contamination. Presently wound strings that lose their tonal qualities must be removed from the instrument and either cleaned or replaced. This process is burdensome, time consuming, and expensive for musicians who play frequently and care about tonal quality.

Another problem encountered with strings requiring fingering along a fingering board (e.g., a guitar fret board) is that a substantial amount of pressure must often be applied by the musician against the fingering board in order to produce different musical notes. This can be discouraging for beginning music students. Accomplished musicians normally develop extensive calluses on their fingers from years of playing their instruments. Despite such calluses, the pressure and friction generated by playing the instruments tends to be one of the primary causes of frustration and fatigue or injury for many musicians.

Still another problem with conventional strings, and particularly conventional wound strings, is that the action of fingering quickly across the strings often generates unwanted noises. For instance, it is common to hear a "squeak" from guitar wound strings as a musician fingers rapidly across a fret board or finger board. In order to avoid such squeaks, the musician must make a concerted effort to completely separate his or her fingers from the strings when repositioning on the fret or finger board. This repositioning action slows the musician's note changes and further increases fatigue.

It would seem that some of these problems could be addressed if the strings could be coated with some substance to avoid contamination of the wound string windings and/or to provide some cushioning or smooth, non-squeak, cover for the strings. For example, Fender Corporation offers a bass guitar string that employs a spiral wrap of a flat, stiff polymer tape (such as nylon) around the wound string. The polymer tape is not adhered to the wound string and does not conform to the underlying bass string, but, instead, is held in place merely by tightly helically wrapping the stiff flat tape around the bass string and holding the tape from unwinding with an outer-wrapping of thread at each end of the guitar string. The polymer tape is wrapped with its side edges abutting without overlap of or adhesion to adjacent tape wraps. Further, if the thread holding the polymer tape is damaged or removed, the polymer tape rapidly uncoils in a helical coil. It is possible to restore the string to the original condition by rewinding the polymer tape about the string and securing it with a thread winding.

While Fender Corporation's use of a stiff tape wrap may help reduce some contamination problems (which does not appear to be claimed by Fender) or may make the string somewhat more comfortable to play, the Fender bass guitar string has a distinctly "dead" sound when played. The relatively heavy and stiff wrapping is believed to limit the amount and duration of vibration of the string, particularly at higher harmonic or overtone frequencies, muffling or "deadening" its sound. As a result of the use of such a non-deformable covering, the string is unsuitable for most guitar applications where a conventional "bright" or "lively" guitar sound is sought.

These problems are addressed in the invention described in U.S. patent application Ser. No. 08/561,774, filed Nov. 22, 1995. These strings employ a unique cover that is deformable along the length of the string. The deformable cover protects the strings from contamination, protects the musician's fingers from abrasion, and reduces or eliminates "squeak." The deformability of the cover allows for the movement of the windings of the strings. The result is a string that has excellent tonal quality.

Despite the tremendous benefits delivered by the strings of the U.S. patent application Ser. No. 08/561,774, a number of possible problems have emerged. First, where the cover is wrapped along the entire length of a guitar string or the like, the cover may wear and fray where the string is strummed with a pick. This does not appear to diminish string sound, but it has raised aesthetic objections. Second, where the cover is wrapped only along the fingering board, the fraying problem is eliminated but a slight intonation problem has been observed. The intonation problem becomes a greater concern when higher notes are played (i.e., when fingering occurs near the 12th fret). These problems have spurred the need for an even more effective covered string.

It is accordingly a primary purpose of the present invention to provide an improved covered musical instrument string that maintains correct intonation.

It is a further purpose of the present invention to provide an improved musical instrument string that retains all the benefits of a covered musical string, including being corrosion resistant in the fret region, and faster, easier, and/or more comfortable to play than conventional strings, and less prone to generating unwanted noises when a musician's fingers are moved along the string.

These and other purposes of the present invention will become evident from review of the following description.

SUMMARY OF THE INVENTION

The present invention is an improved musical instrument string for use on a variety of stringed musical instruments, including but not limited to guitars, double basses, pianos, violins, cellos, etc. The present invention is particularly suitable for use on musical instruments with strings that are prone to contamination and change in tonal quality over time, such as guitars and other instruments that have strings that are extensively handled during use.

The string of the present invention can employ a conventional wound string, such as a string having a center core and a spiral winding used to produce lower notes, and a polymer cover applied around and adhered to the wound string. The preferred cover comprises porous polytetrafluoroethylene (PTFE) in the form of one or more tapes, sheets, or tubes that enwrap the wound string and protect the wound string from contamination. The cover of the present invention is unique over all previous attempts to cover a musical string in that the cover is selected and applied so as not to significantly degrade the normal sound of the musical instrument. The cover therefore is substantially a non-dampening cover.

The cover of the present invention is applied so as to provide a lubricious covering, and to protect the string from contamination and corrosion with little or no interference of the free movement of the wound string. Preferably, an expanded PTFE is employed that is longitudinally stretched so as to be relatively non-deformable in its longitudinal direction and relatively deformable in its transverse direction. By wrapping this cover around the wound string with the longitudinal axis of the cover oriented at an angle to the longitudinal axis of the wound string, the cover will maintain its position and conform to the wound string but will still permit sufficient movement of the windings to maintain tonal quality.

It has been determined that when this cover is attached to only a portion of a musical instrument string, an imbalance in mass is formed over the length of the string (i.e., the mass over one segment of the string is different from the mass over another segment of the string). The result is that a slight but distinct change in intonation has been noted during play. This problem is corrected with the string of the present invention by adjusting the mass of the underlying (i.e., "base" or "main") string along the length of the string. As the terms "base" and "main" are used herein, it is intended to refer to a precursor string of the present invention before a covering is applied. By reducing the relative mass of the portion of the main string that is provided with the polymer covering, it has been shown that correct intonation can be maintained along the entire length of the string. The string's mass need only be adjusted enough to compensate for the mass of the cover added to the string. Such modification of mass of the string can be accomplished through any suitable means, including grinding or otherwise reducing the diameter of the string along the area to be covered, separating the windings of the strings along the area to be covered, and/or adding additional mass to the string along the portion that is left uncovered.

If an adhesive is applied to hold the cover to the wound string, bonding should be accomplished to assure that winding movement is not diminished. For example, a discontinuous coating of adhesive will provide secure attachment of the covering to the winding without interfering with the vibration of the wound strings.

The performance of the string of the present invention can be further enhanced by applying an additional layer of material on the outside of the expanded PTFE covering, such as a fluorinated ethylene propylene (FEP) polymer. This additional layer is believed to provide a number of important benefits, including better adhesion of the cover layer to itself, and improved resistance to wear and contamination. Additionally, it has been observed that an outside layer of such material may actually improve tonal quality of the string over use of a cover without such a layer. Unlike the Fender string's thick polymer cover previously described, the cover of the inventive string cannot be removed from the main string in one continuous piece and cannot be put back on the string when it is removed by damage or dissection.

While contamination resistance and improved string life are important benefits of the present invention, increased finger comfort or "playability" is an equally exciting advantage. The string of the present invention is much more comfortable to use than conventional strings without covers. This results in the ability of a musician to play longer and with less fatigue. Moreover, since a fluoropolymer cover, such as PTFE, or FEP or a composite of these materials, is extremely smooth and slippery, the strings of the present invention are far less prone to "squeaking" during fingering. This allows for faster and less tiring fingering techniques without generating unwanted noise. This is also believed to make the guitar easier to learn and master by beginning players.

DESCRIPTION OF THE DRAWINGS

The operation of the present invention should become apparent from the following description when considered in conjunction with the accompanying drawings, in which:

FIG. 25 is an enlarged longitudinal cross-section view of a string of the present invention having a partial cover and reduced string mass under the portion of the main string that is covered; and.

DETAILED DESCRIPTION OF THE INVENTION

The present invention is an improved string for use with a variety of musical instruments employing strings. It is contemplated that the string of the present invention may be useful in many different types of musical instruments, such as but not limited to guitars, double basses, pianos, violins, cellos, etc.

Figure 1:
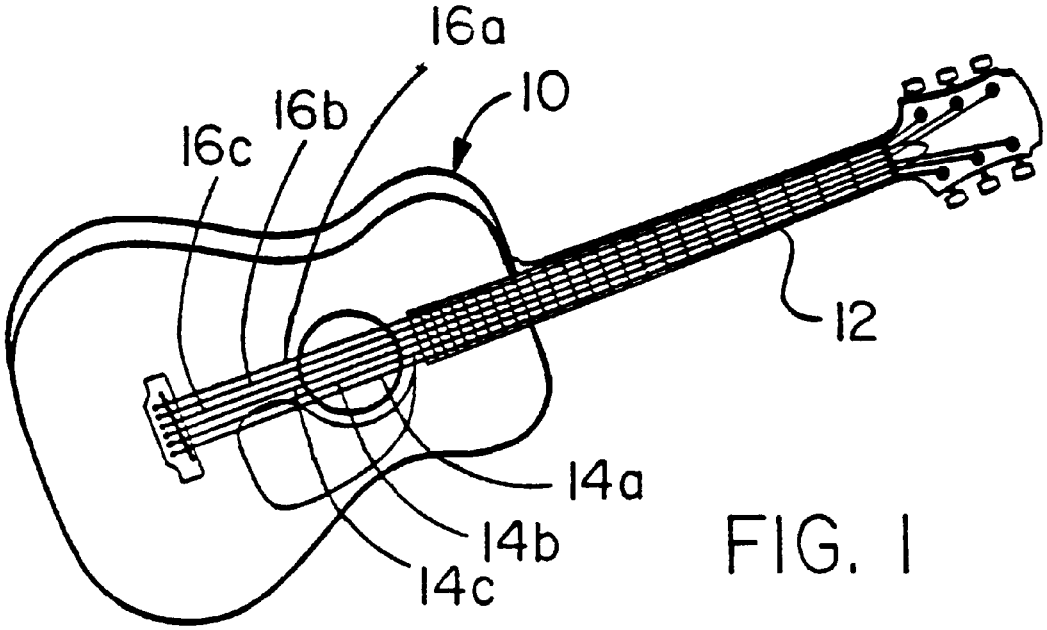
FIG. 1 is a three-quarter perspective view of a guitar having strings of the present invention.

FIG. 1 illustrates a conventional six string guitar 10, one such musical instrument that can benefit from employing the strings of the present invention. All conventional guitars include a "fret" or "fingering board" 12, across which multiple strings, 14*a*, 14*b*, 14*c*, 16*a*, 16*b*, and 16*c*, are strung and against which the strings are pressed to form different notes. A typical six string guitar includes three relatively "high" note strings, 14*a*, 14*b*, 14*c*, and three relatively "low" note (or "bass") strings, 16*a*, 16*b*, 16*c*. High note strings 14 are generally formed from a straight "non-wound" material, such as "catgut," metal, or polymer. In order to achieve significantly lower notes without increasing the length of the string or unduly increasing its thickness, low note strings 16 generally employ a wound string construction.

Figure 2:
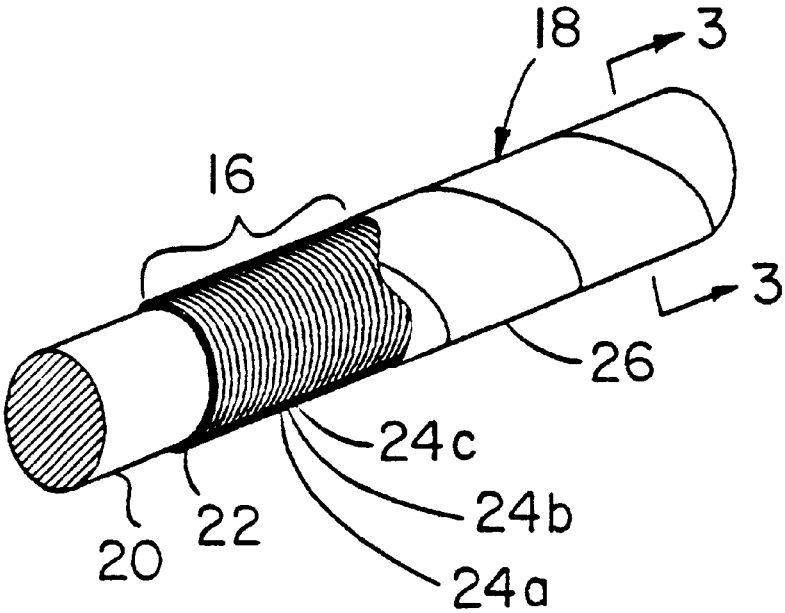
FIG. 2 is a three-quarter isometric view, partially in cut-away, of one embodiment of a string of the present invention.
Figure 3:
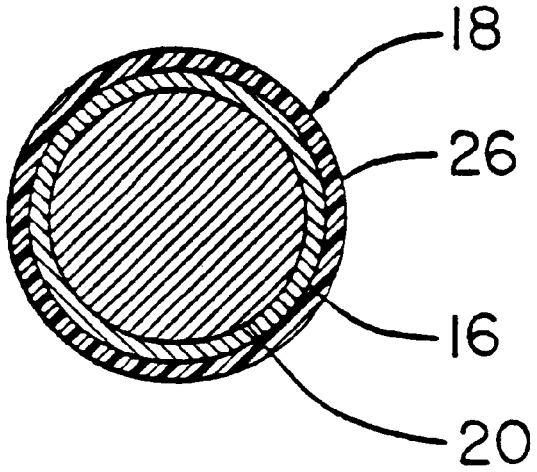
FIG. 3 is an enlarged transverse cross-section view along line 3—3 of FIG. 2, with the cover shown enlarged for detail.

The form of a typical wound string 16 (e.g., a guitar bass string) can be seen inside the string 18 of the present invention illustrated in FIGS. 2 and 3. As is shown, wound strings 16 employ a core 20, such as a straight gauge metal, catgut or polymer, and a winding 22 (e.g., metal or polymer) wrapped repeatedly around the core 20. The winding 22 is held in place around the core by tension and the anchoring of it at its ends.

When a conventional wound string 16 is played for a period of time, it tends to lose its tonal quality apparently due to "contamination" of the string. It is believed that proper tonal quality of a wound string 16 is dependent upon allowing movement between individual wraps 24*a*, 24*b*, 24*c*, etc., of the winding 22 during play. Contamination in the form of dirt, oil, sweat, oxidation, etc., tends to become entrapped within the winding 22, causing limited motion of the individual wraps 24. This is a particular problem on a finger board of an instrument because of the constant handling of the strings in that area. As a result, after a relatively short period of play, wound strings begin to diminish in tonal quality. Professional musicians who care about tonal quality are then often required to remove and replace or clean the wound strings on a regular basis to maintain proper sound.

In order to address this problem, the present invention wraps the wound string 16 with a cover 26 along at least a portion of its length. The cover 26 of the present invention serves to seal the winding 22 of the string from contamination during handling, while avoiding the problem of restricting movement of the individual wraps 24.

The form of the cover 26 is believed to be quite important in the operation of the present invention. Although a wound string 16 may theoretically be wrapped with virtually any material to reduce contamination, there are a number of important considerations in choosing an appropriate cover. The foremost problem with encasing the strings in some covering is that many covering materials tend to deaden the sound of the strings. This result is to be expected when a string vibrates somewhat out of phase with a cover, which will naturally reduce the amount and duration of the vibration of the string. A cover that is not adhered to the strings, such as that employed with the Fender Corporation wrapped bass strings, has been shown to produce a particularly "dead" sound. However, adhering and conforming a cover to the strings may tend to restrict the movement between the individual wraps 24 of the winding. This may also be expected to deaden the sound, much in the same way as contamination does.

Another problem with any string cover is that the cover must be capable of withstanding substantial wear and abrasion during use. While adhesion of the cover to the underlying string may reduce abrasion between the cover and the string during use, as has been noted, such adhesion may also restrict the vibration of the string.

The present invention solves the problem of string contamination with minimal diminishing of the lively sound of the string. This is accomplished by wrapping at least a portion of the string with a polymer cover that is deformable enough to allow movement of the wraps of the winding during play. Preferably, the cover is formed from a material that is deformable enough to permit relatively free movement of the wraps 24 even when the cover is at least partially adhered to the winding. Further, it is important that the cover be sufficiently durable to withstand the abrasion occasioned by playing of the string.

As the term "deformable" is used herein, it is intended to include any process or state whereby a covering material alters its shape under the normal pressures and stresses encountered by a musical instrument string. It is particularly preferable that a deformable cover used in the present invention allows for the normal movement of string windings along the longitudinal axis of the string while including at least some recovery (that is, elasticity) so that the cover tends to return to its original shape upon removal of the pressure or stress. The cover of the present invention should be sufficiently deformable along the length of the string so as to maintain the tonal quality of the string.

Materials suitable for use as a cover of the present invention include, but are not limited to, the following: polytetrafluoroethylene (PTFE) including porous PTFE and particularly including porous expanded PTFE (ePTFE); fluorinated ethylene propylene (FEP); polyethylene including ultrahigh molecular weight polyethylene; perfluoro alkoxy resin (PFA); polyurethane; polypropylene; polyester; polyimide; and polyamide.

The preferred string cover of the present invention comprises a porous polymer material such as uniaxially expanded polytetrafluoroethylene. This material has demonstrated exceptional durability with properties that maintain excellent tonal qualities for the covered string. Porous expanded PTFE, such as that made in accordance with U.S. Pat. Nos. 3,953,566, 3,962,153, 4,096,227, and 4,187,390, all incorporated by reference, comprises a porous network of polymeric nodes and interconnecting fibrils. This material is commercially available in a variety of forms from W. L. Gore & Associates, Inc., Newark, Del.

Expanded PTFE is formed when PTFE is heated and rapidly expanded by stretching in at least one direction in the manner described in the above listed patents. The resulting expanded PTFE material achieves a number of desirable properties, including exceptional strength in the direction of expansion, and exceptionally high flexibility, and conformability. Interestingly, although expanded PTFE material is quite strong and relatively non-deformable in the direction of expansion, the oriented characteristics of the fibrillar microstructure make the material relatively deformable and easily distorted in a direction other than the direction of stretch. As is known, the amount of strength and deformability of the expanded PTFE can be adjusted by varying the expansion procedures, providing a wide degree of strength, porosity, and deformability in different directions by changing the direction and amount of expansion.

As the term "expanded PTFE" is used herein, it is intended to include any PTFE material having a node and fibril structure, including in the range from a slightly expanded structure having fibrils extending from relatively large nodes of polymeric material, to an extremely expanded structure having fibrils that merely intersect with one another at nodal points. The fibrillar character of the structure is identified by microscopy. While the nodes may easily be identified for some structures, many extremely expanded structures consist almost exclusively of fibrils with nodes appearing only as the intersection point of fibrils.

The preferred expanded PTFE cover for use with most wound strings is one with above about 50% porosity.

For use on a conventional guitar, the string may be covered only along the fret board, where the strings undergo the greatest amount of handling. By leaving the string uncovered in the region where the string is strummed, the life of the string of the present invention is believed to be prolonged since the cover will not be exposed to harsh wear from a pick, fingernails, etc., imparted during the process of play. It should be understood, however, that suitable strings of the present invention may include covers extending over the strumming region of the string. In fact, such a construction may be beneficial under certain conditions, such as when the strings are being played with fingers alone.

It is believed that by wrapping the film about the string at an angle closer to perpendicular to the longitudinal axis of the string that abrasion resistance of the covering is improved. Conversely, however, sound quality of the string may be adversely affected as this wrap angle approaches perpendicular. At the present time a wrap angle of about 20 to 30 degrees off perpendicular in the strumming region of the string is believed to be preferred to balance durability with tonal quality. Alternatively by wrapping the film about the string at an angle further from perpendicular to the longitudinal axis improves the feel and comfort of the string. Wrap angles of about 30 to 60 degrees off perpendicular in the fret region of the string are believed to be preferred to optimize comfort and tonal quality. Consequently, it may be preferred to combine the two different wrap angles on the same string covering the entire string (that is a first wrap angle for the fret region and second wrap angle for the strumming region).

The difficulty in using two different wrap angles on two different portions of the same string is that if the same length of tape having a constant width and thickness is used for the two different wrap angles, the wrap angle closest to perpendicular results in more overlap of the tape and a greater mass per unit length of the covering in that region of the string. This can be avoided by using a separate length of tape for the portion having the wrap angle closest to perpendicular wherein the tape is narrower and/or thinner so that less mass is added with each wrap of the tape. Alternatively, if the wrap angles differ in mass per unit length of the string by a ratio of about 2:1, the lighter covered region (wrap angle furthest from perpendicular) can be wrapped twice with the same tape by wrapping down the string in one direction and then after reaching the end of the string, wrapping a second layer back in the opposite direction whereby the mass of the tape in that portion of the string is doubled and matches the mass per unit length of the wrap angle closest to perpendicular.

It should be noted that direction and pitch of the cover wrapping in relation to the direction and pitch of the winding of the main string may effect abrasion, comfort, and tonal quality of the string.

There are a number of ways that the string of the present invention may be even further improved. First, while the cover of the present invention may be applied with the tension of a helical wrap (such as the wrap of the cover 26 shown in FIG. 2) alone keeping it attached to the string, it is believed preferred to employ some form of adhesive on the cover before it is applied to the string, and/or a coating over the cover to help retain the cover to the string. In choosing an adhesive, it is very important to keep in mind that an adhesive applied under the cover may have the undesirable effect of adhering the windings of the string together, thereby limiting the vibration of the string.

Figure 4:
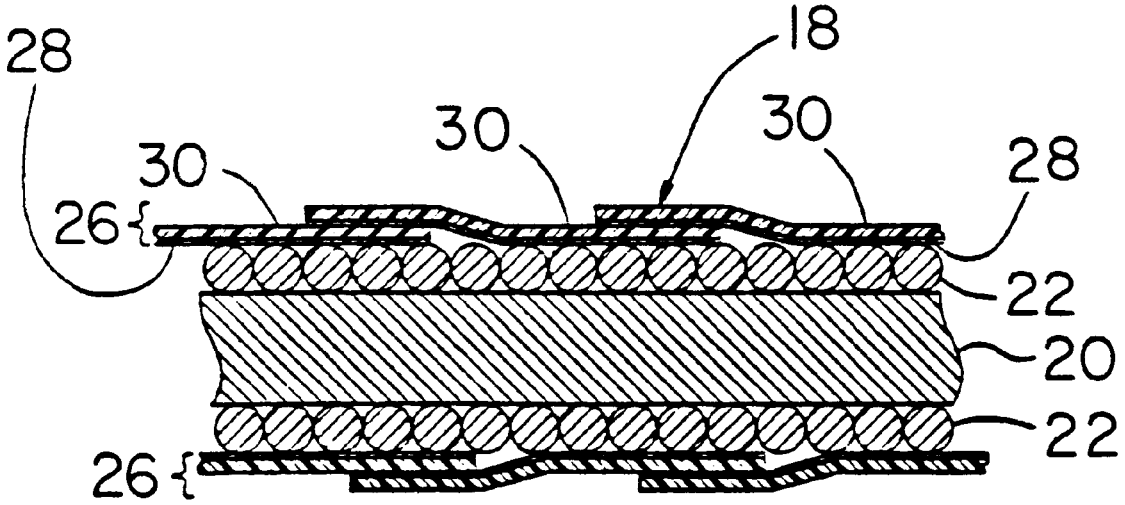
FIG. 4 is an enlarged longitudinal cross-section view of a portion of the cover of the string of FIGS. 2 and 3.

One method of attaching the cover 26 to the winding 22 is by using a continuous or discontinuous coating of adhesive. As is shown in FIG. 4, by applying adhesive coating 28 to a polymer layer 30, sufficient adhesion can be provided without introducing enough adhesive to seep within the winding 22. In this manner, the adhesive will not interfere with the normal movement between the windings.

A number of different adhesives may be employed in the present invention. The adhesives can be thermoplastic, thermosetting, or reaction curing types, in liquid or solid form, selected from the classes including, but not limited to, polyamides, polyacrylamides, polyesters, polyolefins (e.g., polyethylene), polyurethanes, and the like. Particular adhesives that may be employed in the present invention include polyurethane, FEP, or PFA. Suitable application means include gravure printing, spray coating, powder coating, and the like.

The preferred polymer cover is expanded PTFE, and the preferred adhesive coatings are thermoplastics of lower melt point than the crystalline melt point of the PTFE. Thermoplastic adhesives such as FEP #NP-20FG films available from Norton Performance Plastics are most preferred.

Coated porous expanded PTFE film can be made by a process which comprises the steps of:

a) contacting one surface of a porous PTFE substrate, usually in the form of a membrane or film approximately 0.025 mm (0.001") thick, with another layer which is preferably a film of FEP approximately 0.012 mm (0.0005") to 0.05 mm (0.002") thick or alternatively of another thermoplastic polymer;

b) heating the composition obtained in step a) to a temperature above the melting point of the thermoplastic polymer;

c) stretching the heated composition of step b) at about 4:1 ratio while maintaining the temperature above the melting point of the thermoplastic polymer; and d) cooling the product of step c); and e) slitting the film to the desired application width.

In addition to FEP, other thermoplastic polymers including thermoplastic fluoropolymers may also be used to make this coated film. The adhesive coating on the porous expanded PTFE film may be either continuous (i.e., covering virtually all of the surface pores of the porous PTFE and rendering the cover essentially non-porous) or discontinuous (i.e., leaving some of the surface uncovered, thereby maintaining some degree of cover porosity through the coated film) depending primarily on the amount and rate of stretching, the temperature during stretching, and the thickness of the adhesive prior to stretching.

The cover of the present invention may be applied in a variety of manners while maintaining the benefits of the present invention. In addition to the preferred helical wrapping of the cover described above, the cover may also be wrapped longitudinally (in a "cigarette wrap" manner), or as a continuous and seamless tube surrounding the string. Regardless of the type of covering procedure, it is believed important that the cover remains deformable in the longitudinal axis of the string. Multiple layers may also be applied.

Figure 5:
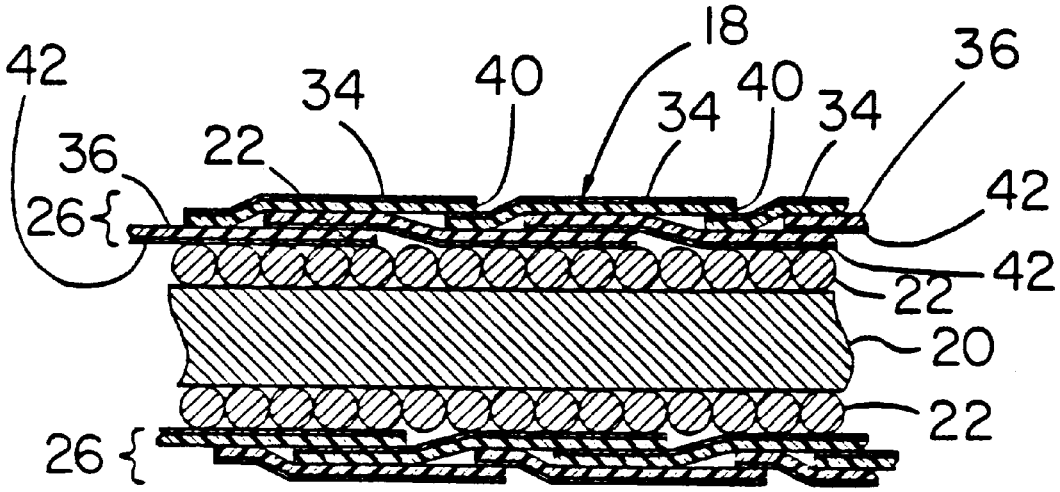
FIG. 5 is an enlarged longitudinal cross-section view of a portion of the cover of a second embodiment of a string of the present invention.

It should be appreciated that the cover of the present invention may be formed through a number of different constructions. FIG. 5 illustrates a cover 26 that employs an outer coating 34, a first polymer layer 36, a second polymer layer 40, and a continuous or discontinuous adhesive layer 42 adhered to first polymer layer 36. This construction provides a thicker and more durable cover 26. Additionally, by providing multiple polymer layers 36, 40, the deformable and strength properties of the cover can be further optimized.

Figure 6:
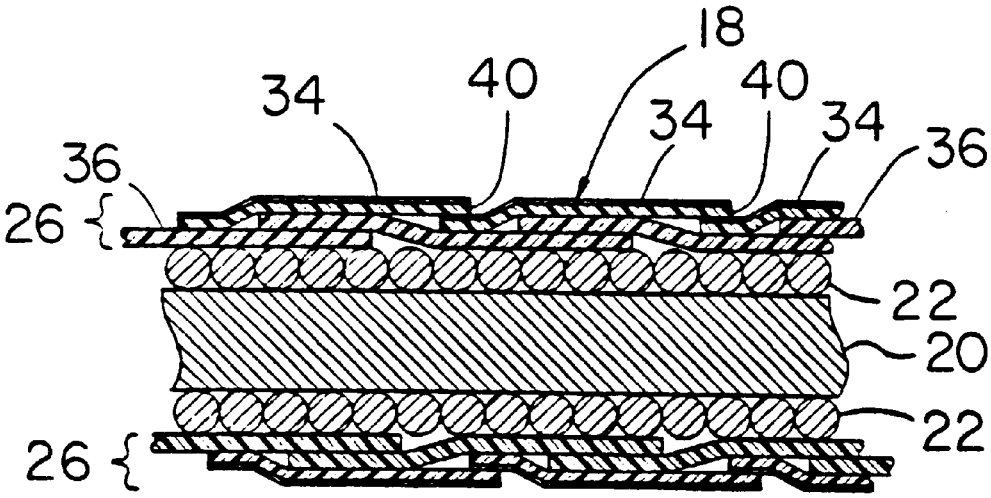
FIG. 6 is an enlarged longitudinal cross-section view of a portion of the cover of a third embodiment of a string of the present invention.

It is most preferred to provide at least two polymer layers of expanded PTFE, each having been stretched in a longitudinal direction, with each of the expanded PTFE layers wrapped at different angles to each other. This is accomplished by two sequential helical wrappings applied over the instrument string at approximately equal but opposite pitch angles which are measured respectively from opposite ends of the longitudinal axis of the string (i.e., the pitch angles of the first and second wrappings are measured from opposite ends of the string). This construction is believed to provide excellent strength and durability while maintaining good deformability along the length of the string. Still another embodiment of the present invention is shown in FIG. 6. In this instance, the cover 26 comprises an outer coating 34, a first polymer layer 36, and a second polymer layer 40 over winding 22. While the polymer layer 36 may be attached to the winding 22 with some form of adhesive, it is believed that a tight wrap of the polymer cover layers 36 and 40 may be adequately secured by the outer coating 34.

Figure 7:
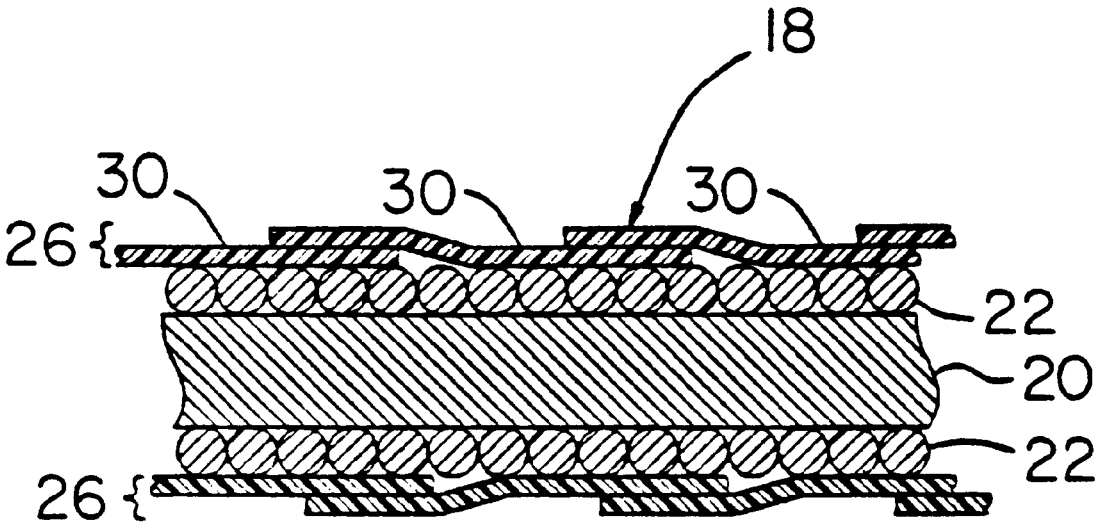
FIG. 7 is an enlarged longitudinal cross-section view of a fourth embodiment of a string of the present invention.

A further example of the present invention is shown in FIG. 7. In this embodiment, winding 22 is provided with a cover 26 in the form of a wrapped polymer layer 30 having overlapping edges and thereby forming a continuous cover. The polymer layer may optionally be heated to thermally bond the overlapped edges together. The cover 26 may or may not include an adhesive coating on its outwardly facing surface, such as a coating of FEP polymer. The adhesive coating serves to adhere the wraps together and also provides an additional protective layer to shield the cover from wear and contamination.

Figure 8:
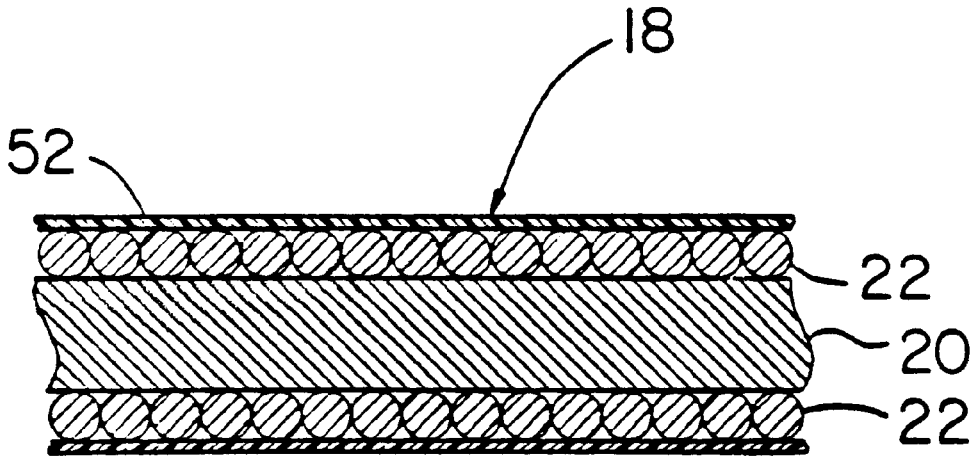
FIG. 8 is an enlarged longitudinal cross-section view of a fifth embodiment of a string of the present invention.

Yet another embodiment of the present invention is shown in FIG. 8. In this embodiment, windings 22 are protected within a continuous and seamless polymer cover 52. The preferred continuous and seamless cover comprises a sleeve of polymer material (such as a thin, extruded sleeve of expanded PTFE, FEP, PFA, or the like). While the sleeve cover 52 may be adhered in place, it may be desirable to provide a sleeve of PTFE or other shrinkable material that can be shrunk by heat or tension around the winding 22. Again, it is believed that the cover 52 should be sufficiently deformable along its longitudinal axis to permit relatively free movement of the windings.

In addition to protecting the strings of the present invention from contamination, it has been determined that the cover of the present invention also makes the strings easier to play. The cover provides some cushioning of the strings and provides a layer of protection from the friction of conventional strings against a musician's fingers. The result is a string that is much easier to play for longer periods of time without discomfort and with less fatigue.

Another important advantage of the strings of the present invention is that they experience significantly less unwanted noise when played. It has been shown that the familiar "squeak" that occasionally occurs when conventional wound strings are rapidly fingered along their length can be diminished or eliminated using the strings of the present invention. The inventive string therefore should allow faster and easier fingering techniques without unwanted noise and with greatly reduced fatigue. It is believed that the elimination of the extraneous "squeak" noise of guitar or other musical instrument strings without diminishing the tonal quality of the strings may result in one of the most important benefits of the present invention.

It should be noted that some of the beneficial results of the present invention may be realized by employing an adhered polymer coating alone as a cover. Suitable polymers for this application may include PTFE dispersion, polyurethane, FEP, PFA, or the like. A PTFE dispersion can be coated on the string and then baked in place. Polymers such as polyurethane, FEP, PFA, etc., will adhere to the string and may be employed as adhesives or further processed to improve adhesion or durability.

Figure 9:
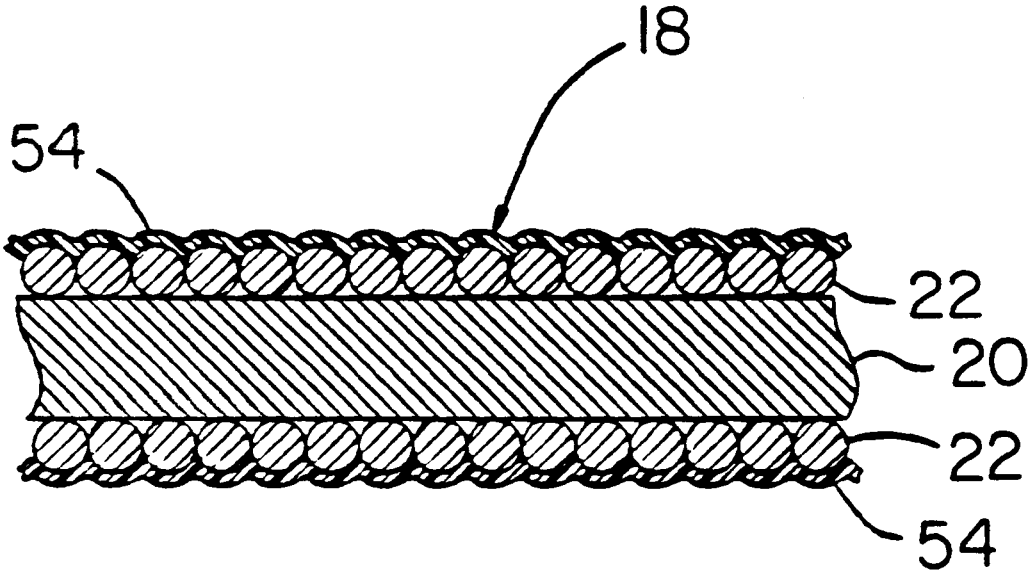
FIG. 9 is an enlarged longitudinal cross-section view of still another embodiment of a string of the present invention, wherein a coating provided as a covering for a wound string.
Figure 10:
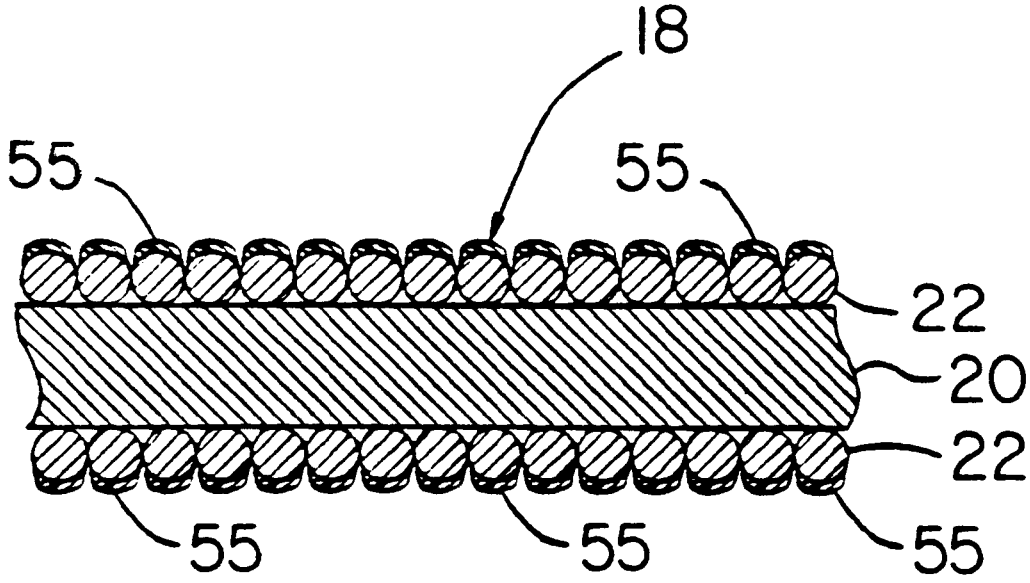
FIG. 10 is an enlarged longitudinal cross-section view of yet another embodiment of a string of the present invention, wherein another embodiment of a coating is provided as a covering for a wound string.

FIGS. 9 and 10 illustrate two embodiments of such coatings applied to wound strings. FIG. 9 shows an enlarged longitudinal cross section of an embodiment wherein coating 54 provides a continuous covering of the wound string in that the coating 54 spans adjacent windings without helical abutted seams 22. Alternatively, as shown by the enlarged longitudinal cross section of FIG. 10, coating 55 may provide a polymeric covering that does not span between adjacent individual windings 22. In this instance, it is preferred that the discontinuous coating 55 on each winding 22 closely abuts the adjacent discontinuous coating 55 so as to limit penetration of contamination between the windings.

Polymeric coverings may also be provided for straight (non-wound) strings as well as for wound strings. Such a covering on a straight string provides increased lubricity and protection from corrosion and consequently allows faster and more comfortable playing. The covering may be provided along only a portion of the length of a string if desired. For example, the covering may be provided only along the fret board portion of a guitar string.

Figure 11:
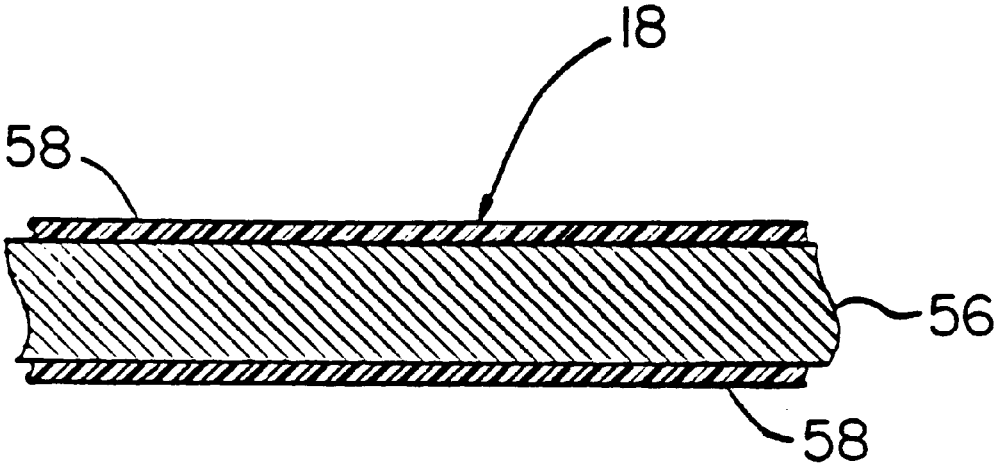
FIG. 11 is an enlarged longitudinal cross-section view of a covering of the present invention on a straight musical instrument string.
Figure 12:
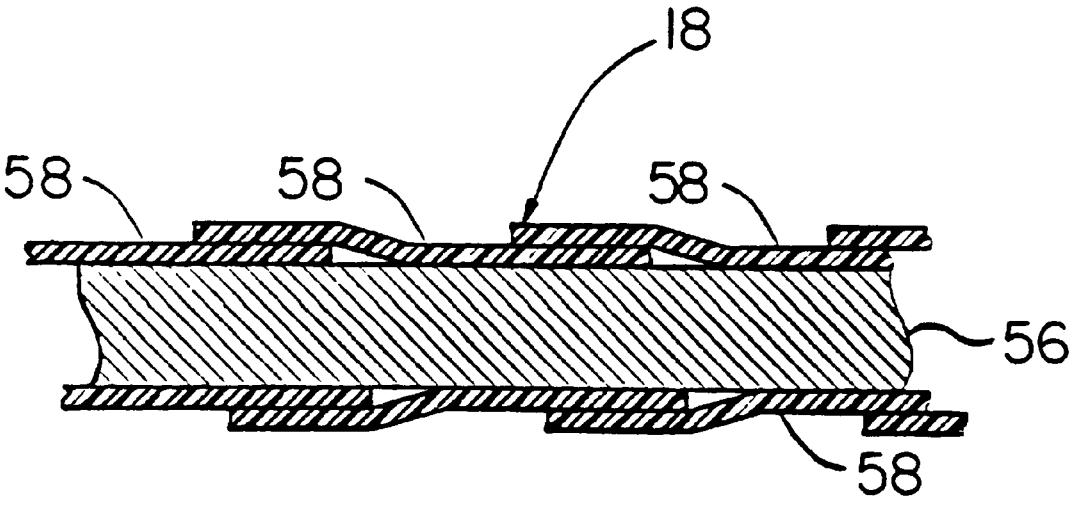
FIG. 12 is an enlarged longitudinal cross-section view of another embodiment of a covering of the present invention on a straight musical instrument string.
Figure 13:
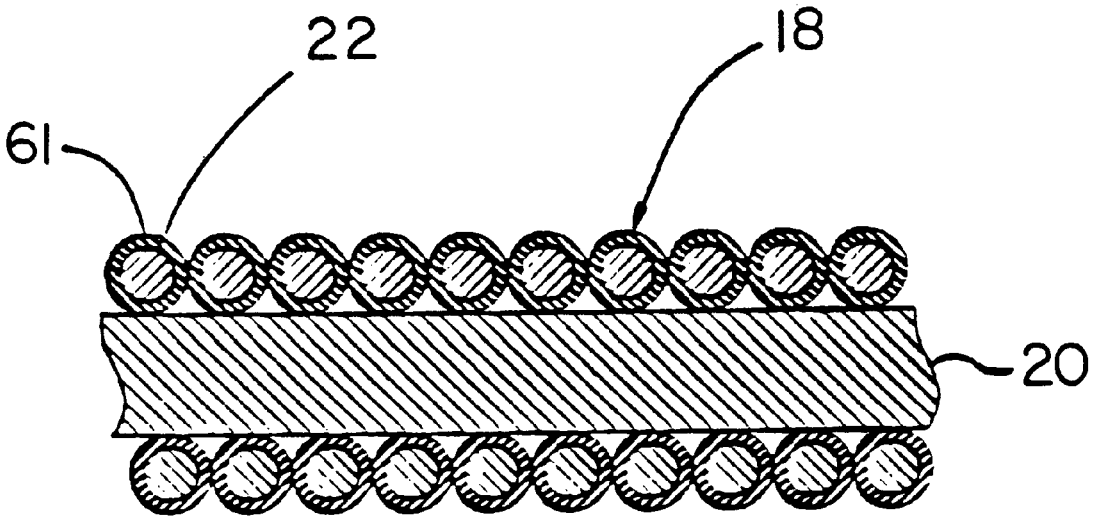
FIG. 13 is an enlarged longitudinal cross-section view of another embodiment of a string of the present invention, wherein a covering is provided around each of the individual windings of the wound string.

FIG. 11 shows an enlarged longitudinal cross section of a straight string 56 provided with a continuous and seamless covering 58 over at least a portion of the length of string 56. Covering 58 may take the form of a continuous and seamless tube, such as a length of heat shrink tubing fitted over string 56, or may take the form of a coating of the types described previously adhered to the surface of string 56. As shown by the enlarged longitudinal cross section of FIG. 12, covering 58 over straight string 56 may also take the form of a polymeric film helically wrapped around the string 56 so as to have overlapping edges, thereby forming a continuous covering. Such a film covering may or may not be adhered to the surface of the string 56. Appropriate films for use in this embodiment are of the types described previously as coverings for wound strings. FIG. 13 illustrates still another embodiment of the invention wherein the covering 61 is applied to the winding 22 prior to being wound onto the core 20. This covering may also be in the form of a coating.

As described in the examples below, the application of the inventive covering in most cases requires the application of elevated temperatures. The covered portion of the inventive string has good resistance to oxidation and discoloration at ambient temperatures. However, this portion of the string can oxidize and discolor at elevated temperatures. It has been found that by heating the inventive musical string in an atmosphere of a reduced concentration of oxygen, most of the oxidation and discoloration can be eliminated. Examples of inert atmosphere gases include but are not limited to welding gases such as argon, carbon dioxide, helium, and nitrogen. Mixtures of combinations of these gases may also be used. It is believed that nitrogen provides an adequate inert atmosphere at the best economy.

Accordingly, it is an improved aspect of the present invention to process the strings of the present invention at an elevated temperature in an environment having an increased concentration of inert gases. This is intended to encompass any environment where oxygen concentration is reduced or eliminated in favor of one or more inert gases such as nitrogen. Preferably oxygen concentration is sufficiently reduced so as not to support combustion in the oven. For instance, oxygen concentration can be confirmed to be sufficiently low if a gas-powered flame (e.g., one on a butane lighter) is extinguished in the oven when set at processing concentrations of inert gas.

One of the additional benefits that may be experienced with the present invention is improved shelf life of the strings. Musical instrument strings often begin to degrade while being stored before they are even installed. The primary problem in this regard is believed to be oxidation that attacks both wound and unwound strings while they are stored in their original packaging. The cover of the present invention can serve to seal the strings from air and moisture, thus reducing or eliminating this problem. It is contemplated within the scope of the present invention to provide a cover along the entire length of the strings in their original packaging to further protect against such contamination problems. The strings can then be used with the entire string covered or scoring can be provided to allow unwanted portion of the covering to be removed from the string (e.g., stripped) before they are played.

Without intending to limit the scope of the present invention, the following examples illustrate how the present invention may be made and used:

Example 1

Figure 14:
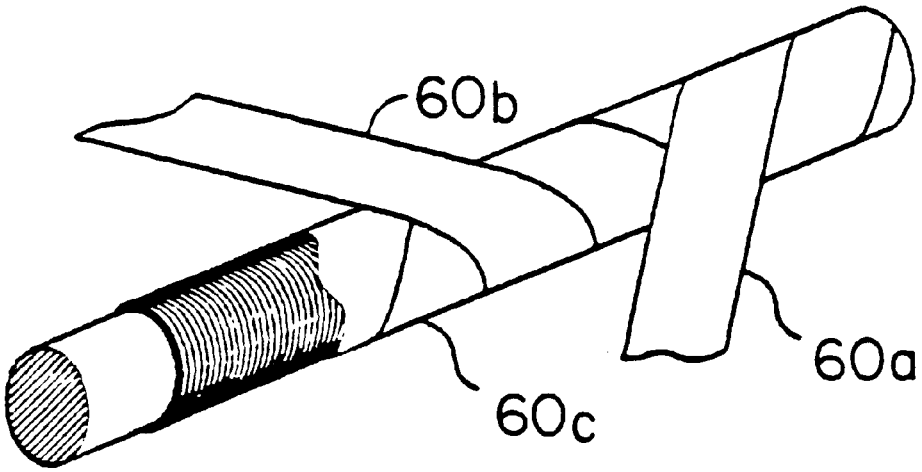
FIG. 14 is a three-quarter isometric view, partially in cutaway, of another embodiment of a string of the present invention, in this instance employing a wrap of three (3) opposing layers.

This Example was made from a purchased FENDER 150SXL nickel wound guitar strings 0.61 mm (0.024 in.), 0.81 mm (0.032 in.), and 1.067 mm (0.042 in.) diameters. The covering was two types of ePTFE film, one type provided with a continuous coating of FEP adhesive on one surface and one with a discontinuous coating of FEP on one surface. Both types of ePTFE film had average fibril length of about 50 microns and a bulk density of about 0.35 g/cc. Average fibril length was estimated from scanning electron micrographs of the surface of the ePTFE film. The film with a continuous coating of FEP was 0.025 mm (0.001 in.) thick. The film with a discontinuous coating of FEP was 0.015 mm (0.0006 in.) thick. As is shown on FIG. 14, the wrap configuration was a bias wrapping of three (3) 6.35 mm (¼ in.) wide composite film tapes 60*a*, 60*b*, 60*c* placed in alternating layers with each layer applied in a different direction. The tapes were wrapped with approximately 50% overlap at approximately 30° from perpendicular to the string longitudinal axis. The first layer was ePTFE with a continuous FEP coating facing down on the wire; the second layer was ePTFE with a discontinuous FEP coating facing up away from the wire; and a third layer was ePTFE with a continuous FEP coating facing up away from the wire.

The string was placed under tension and heated to 345° C. in a convection oven set at 375° C. The string was removed from the oven when the surface of the string reached 345° C., as determined by a thermocouple attached to the exposed metal surface of the string and monitored by a readout.

Example 2

This example was made from a purchased FENDER 150SXL nickel guitar string 1.067 mm (0.042 in.) diameter. The cover was ePTFE film with no adhesive and approximately 0.010 mm (0.0004 in.) thick. The ePTFE film had an average fibril length of about 70 microns and a bulk density of 0.30 g/cc. The tape and wrap configuration was a bias wrap as in Example 1 except that only two alternating layers were applied in opposing directions. The string was heated as described in Example 1.

Example 3

This example was made from purchased ERNIE BALL nickel wound 0.61 mm (0.024 in.) and 1.067 mm (0.042 in.)

diameter guitar strings. The strings were covered with a continuous length of TFE shrink tubing from Zeus Industrial Products, Inc., of Raritan, N.J. The coverings were shrunk around the strings by heating the strings to 327° C. in an oven set at 375° C., as determined by a thermocouple and temperature readout as in previous examples. Covers were as follows:

| Guitar String Dia. | Shrink Tube Cover |
|---|---|
| 0.61 mm (0.024 in.) | 0.76 mm (0.030 in) to 0.31 mm (0.012 in.) dia × 0.08 mm (0.003 in) wall thickness |
| 1.067 mm (0.042 in.) | 1.17 mm (0.046 in) to 0.56 mm (0.022 in.) dia × 0.05 mm (0.002 in) wall thickness |

Example 4

This example was made from a purchased ERNIE BALL nickel wound string 0.81 mm (0.032 in.) diameter. This string was covered with a ZEUS 1.17 mm to 0.56 mm (0.046 in. to 0.022 in.) TFE shrink tube as in Example 3. The string was tested and the performance recorded before the shrink tube was heated and conformed to the wire.

Example 5

This example was made from a purchased FENDER 150SXL 1.067 mm (0.042 in.) diameter nickel wound guitar string. The string was helically tape-wrapped (one layer and one direction) with 3M Scotch 35 vinyl plastic electrical tape (available from 3M, Hutchinson, Minn.) with the adhesive against the wound wire. The tape was slit into 6.35 mm (¼ in.) width and applied as in other examples. No heating was performed.

Example 6

This example was made from a purchased FENDER 150SXL 1.067 mm (0.042 in.) diameter nickel wound guitar string. The string was covered with porous ultra high molecular weight polyethylene approximately 0.015 mm (0.006 in.) thick. The process involved helically tape-wrapping as in other examples. The film was applied in one layer and in one direction with approximately 50% overlap. The string was then heated in the convection oven set at 200° C. and removed when the wire string reached 175° C., as determined by a thermocouple and readout as in other examples.

Example 7

A series of sample strings were made using a purchased FENDER bass guitar string #2200 2.33 mm (0.092 in.) diameter provided by Fender with a wrapping of polyamide (nylon flat tape) having abutted edges. The tape measured approximately 0.97 mm (0.038 in.) wide and approximately 0.33 mm (0.013 in.) thick.

To conduct a comparative test, four test samples were made using the same string. The samples were constructed as follows:

Sample 1: the FENDER string as received in the commercial package.

Sample 2: the FENDER string of Sample 1 was stripped of the nylon cover and tested as a bare metal wire wound string. This was the control string against which the other Fender samples of this example were tested.

Sample 3: the string of Sample 2 was covered with the two types of ePTFE films as used in Example 1. Four total layers in alternating directions were applied to the string:

Layer 1: ePTFE film with continuous coating of FEP; FEP oriented down on the wire.

Layer 2: ePTFE film with discontinuous coating of FEP; FEP oriented up away from the wire.

Layer 3: ePTFE with discontinuous coating of FEP; FEP side oriented down on the first two layers.

Layer 4: ePTFE with continuous FEP coating; FEP facing up away from wire.

The covered string was heated as described in Example 1.

Sample 4: the string used in the previous three samples was used again but with the addition of two layers of the ePTFE film described in the previous sample;

Layer 5: ePTFE film with continuous FEP coating; FEP oriented down on the wire.

Layer 6: ePTFE film with continuous FEP coating; FEP oriented up away from the wire.

Again the string was heated as described in Example 1.

Example 8

This example was made from a purchased D'ADDARIO wound guitar string part number J-16 Phosphorous Bronze Light 1.35 mm (0.053 inch) diameter. The object of this example was to construct a covered string with a constant mass per unit length using two different wrapping angles on two different segments of the string.

The process involved tape-wrapping with a film provided with a continuous coating of FEP as in Example 1. A ⅛ inch wide tape was selected for the covering. The FEP coated side was oriented facing down on the string windings. The tape-wrapping was started at a point approximately 40 cm from one end of the string (the fret segment) at an angle approximately 58° from perpendicular to the string longitudinal axis. The tape-wrapping sequence involved: traversing the wrapping at 6.68 mm (0.263 inch) per revolution to one end of the string, reversing the 58° angle to the opposite direction, traversing the wrapping back to the starting point, changing the wrap angle to 25° from perpendicular to the longitudinal axis of the string and traversing the wrapping at 1.98 mm (0.078 inch) per revolution over the remaining uncovered segment (strumming segment) of the string. The finished string thus had two helical wrappings of the film applied at opposing 58° wrap angles on the fret region of the string and a single helical wrapping applied at a 25° wrap angle on the strumming region of the string. Wrapping at the 25° angle produced about twice as much overlap as the preceding wrapping at 58°. The covered string was not heated in a convection oven as in other examples.

To evaluate the mass of the string segments, the string was cut into two 25 cm lengths (one with 25° wrapping and one with 58° wrapping). First the string segments were weighed on a gram scale (calibrated to ±0.004 g) followed by removal of the PTFE covering. Next the individual components were weighed separately on the same scale and the values recorded:

Covered String
- Fret segment=2.671 g
- Strumming segment=2.676 g

Covering Only
- Fret segment=0.094 g
- Strumming segment=0.090 g

Wound String Only
- Fret segment=2.576 g
- Strumming segment=2.585 g

The above example demonstrates that by adjusting wrap angle and the feed rate of tape-wrapping a musical string of constant mass per unit length can be constructed to achieve the optimum material properties in each segment of the string.

Example 9

To demonstrate that the inventive string is less prone to unwanted noises associated with playing a sound test was performed. A GHS Progressive Electric Bass String 2.66 mm (0.105 inch) diameter was covered with a PTFE covering film provided with a continuous coating of FEP as in Example 1. The covering was applied with the FEP coated side facing down onto the wound string. The film tape was wrapped with approximately 50% overlap and at an angle approximately 30° from perpendicular to the string longitudinal axis. Only the fret segment (approximately 60% of the string length) was covered with two layers, each layer being applied in the same direction. The string was also heated as in Example 1.

To perform the sound test, a sound level meter SPL-103 manufactured by Columbia Research Laboratories, Inc. was used to monitor sounds made by a celluloid pick being dragged along the longitudinal axis of the string in the covered segment and uncovered segment of the string. To ensure consistency of the test, a fixture was constructed to apply 87 grams of force on the pick to the string surface and 163 grams of force for the lateral movement of the pick parallel to the longitudinal axis of the string.

With the weighted response set on the A scale and the meter set to the 90 dB range, the mean value for four sample tests was approximately 2 dB for the uncovered segment and approximately −6 dB for the covered segment.

Example 10

This example was made from the same type of string of Example 8. The construction was also identical to Example 8 with the exception of employing a ¼ inch wide film tape and heated as in Example 1. The object of this example was to demonstrate the deformable characteristic of the inventive covering.

To evaluate the string covering, a section of cover material approximately 50 mm×2.5 mm was removed from the fret segment of the string. This was accomplished by grinding the string along the longitudinal axis (on one side of the string in the fret area) and peeling the untouched portion (the side opposite of the grinding) of the cover from the string windings.

A 38.1 mm (1.5 inch) section was marked on the sample as measured by a caliper. Next the sample was gripped at each end with clamping hemostats and pulled slowly by hand in the longitudinal direction to about 6 percent elongation and allowed to relax. After approximately 5 seconds the sample was again measured and determined to be the same length as its initial length.

Example 11

This example was accomplished by using MARTIN medium acoustic guitar strings. The object was to provide further evidence of the strings of the present invention exhibiting less of the unwanted squeaking noise associated with playing a stringed instrument. To provide a subjective example of this characteristic, a professional musician played a song while being recorded. First, the musician played the song on an EPIPHONE #PR350CE acoustic guitar equipped with the MARTIN medium acoustic guitar strings as purchased. Second, the musician played the song again on an identical guitar equipped with identical MARTIN strings supplied with a covering identical to the covering described in Example 9. The entire length of the wound strings were covered for this example.

A review of the resulting audio recording demonstrates that the strings of the present invention exhibit less squeaking noise (i.e., extraneous noise of the musician's fingers passing along the strings) while being played.

Testing

Guitar strings from Examples 1–6 described above and comparable uncovered control strings were individually installed and tested on a PEAVY PREDATOR electric guitar. The string of Example 7 was installed and tested on a FENDER Jazz Electric Bass Guitar. The pickup of each guitar was amplified by using an ENVOY 110 amplifier. An HP 35670A dynamic signal analyzer was then connected to the amplifier output jack to both monitor and capture signal output. A fixture with a spring loaded mechanical arm was employed to create a consistent deflection of each string tested.

The control strings of Examples 1–6 were strings as purchased from the manufacturer which were compared to the inventive covered strings of the same type and size. The comparative data in Table 1 describe the difference of the amplitude of a sound produced by the control string versus the comparable inventive covered string for various harmonics, based on equal amplitude signals from both strings at the fundamental harmonic (i.e., the amplitudes (of the control and inventive strings) at the fundamental frequency were adjusted to a difference of zero). Subsequent harmonic values were calculated to reflect the actual amplitude difference in a range of harmonics. For example, if the intensity of the fundamental frequency of a coated string is −59 dB and the intensity of the fundamental of a control string is −62 dB, the adjustment is −3 dB. To obtain the differences in subsequent harmonics the −3 dB adjustment is added to the recorded value for each harmonic on the coated string. The coated string versus the control string difference thus eliminates any variability due to plucking or strumming the string. The data in Table 1 appear only where the dB difference was greater than 2 dB. A positive value indicates a larger amplitude for the covered inventive string than for the comparable control string while a negative value indicates the opposite result. The example types are described at the beginning of each numbered row of Table 1.

The same comparison was made of a FENDER Bass guitar string #2200 as described in Example 7 with additional comparisons for the final (eighth) ¼-second of the two second period. These additional data are described in Table 2. This final ¼-second is believed to be particularly important on a bass guitar since it is generally desired for bass notes to be sustained during play. The FENDER control was Sample 2 of Example 7.

Analysis of the harmonic content and spectral shape of an acoustic wave is a complex problem. The conventional oscilloscope displays a signal in the time domain which represents the amplitude or intensity as a function of time. The amplitude at any instant of time is a result of the superposition of all the amplitudes of all harmonics present. The resulting waveform is a complex, time varying signal. Using a Dynamic Signal Analyzer (DSA) the information content of the recorded signal may be transformed using the Fast Fourier Transform (FFT) from the time domain to the frequency domain. The resulting display depicts the amplitude or intensity at each frequency, effectively decomposing the signal into its components. For the analysis, a Hewlett-Packard model 35670A DSA, serial number 3340-A00485, was used. This analyzer is basically a digital sampling, storage oscilloscope with a built in microprocessor and software which performs the FFT on the signal and displays the result on a CRT or stores the result on a floppy disk for post-processing analysis.

Figure 15:
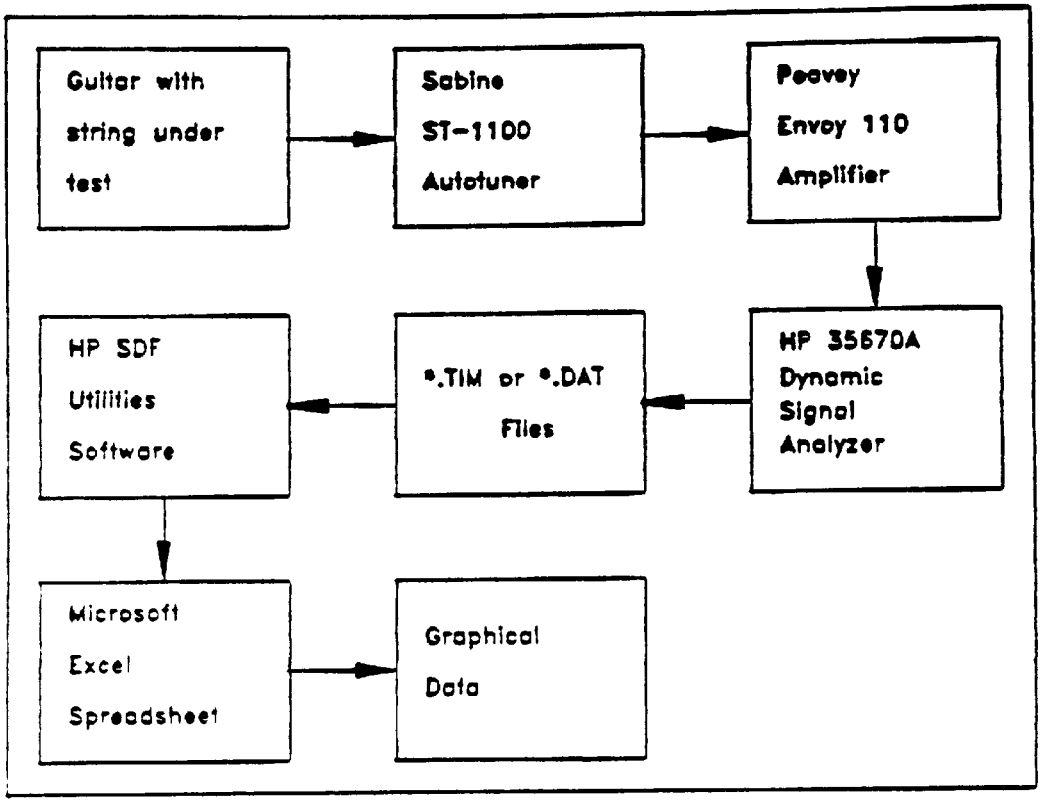
FIG. 15 is a schematic depiction of sound evaluation equipment used to test the strings of the present invention.

An electric guitar body was provided with an electric guitar pickup that directly sensed the string vibration. The fixture with the spring activated mechanical arm was attached to the guitar. A PINK PEARL brand rubber eraser was substituted for a conventional plastic guitar pick to reduce variable noise effects. The analysis equipment is depicted schematically in FIG. 15.

To perform a sound measurement, the string under test was mounted on the guitar body, tuned to the correct pitch using the SABINE ST-1100 Autotuner, and deflected once with the PINK PEARL eraser attached to the test fixture. The DSA was configured to capture the first two seconds of the signal. The analyzer time capture was triggered to begin with the onset of the signal. The analyzer bandwidth was set to 1,600 Hz since there were no significant harmonics present in any of the strings tested beyond the tenth for the highest pitch string (D at a 146.83 Hz fundamental). This resulted in eight (8) blocks of data, each ¼-second long, being recorded with 1024 individual samples per block. The FFT was performed on the stored signal with a resulting frequency resolution of 4 Hz.

The record for the two-second time capture was stored as an HP SDF format data file which is the native data format for the DSA. The FFT traces for the first and last blocks of the eight block capture were also stored. The HP supplied program "Viewdata" was used to examine each stored FFT trace. The peak amplitude of the signal at each harmonic and its corresponding frequency were recorded and input to a MICROSOFT "EXCEL" spreadsheet program for plotting purposes. The data for each covered string were compared to the corresponding control string without a covering by using equal amplitude signals at the fundamental frequency and then taking the difference between the covered and control strings at each higher harmonic. The first ¼-second is believed to be the most relevant for analysis since most guitar music is played with a fairly rapid tempo. The bass guitar string was also analyzed at the final eighth ¼-second block since they are usually played with a longer sustained note. The following subjective conclusions were drawn from this testing:

On A and E strings, the 3 wrap ePTFE results in uniformly higher intensity higher harmonics; on a D string some harmonics were enhanced while others were attenuated.

On E strings, ePTFE applied without adhesive and the TFE shrink tube had broadly higher intensities at higher harmonics. Both vinyl electrical tape and porous UHMWPE had some harmonics enhanced and some attenuated.

The application of loosely applied heat-shrink TFE tubing to an A string results in reduced harmonic content. However, when shrunken as in Example 3 on the E and D string, there is greater intensity in harmonic content across most frequencies.

On the FENDER bass A string, the meaningful comparison is believed to be at the last time frame tested since bass notes tend to be sustained during play. The data were gathered in eight ¼-second blocks, and the comparisons at the eighth block are significant. The non-deformable nylon tape wrapping of the Fender bass guitar string attenuated the harmonic content for all harmonics. The ePTFE covering resulted in increased harmonic intensity for nearly all frequencies.

The presence of a covering alters the harmonic content of the vibrations of a wound vibrating string. When the covering is ePTFE, with or without an adhesive, the resulting covered string vibrates with more energy in the higher harmonics or overtones when compared to a string without a covering tuned to the same pitch. While pronounced increases in harmonic intensity were noted, some specific frequencies were attenuated below those of the controls for some constructions.

Human hearing, which peaks in sensitivity at around 3 kHz, is thus particularly sensitive to higher harmonics of these generally low pitched strings. The subjective interpretation of greater intensity in higher harmonics is that the sound appears "brighter" or "fuller" for the inventive strings, even though one or more specific higher frequencies may be slightly attenuated when compared to the control string without a covering.

In all cases of the covered strings of the present invention, musicians experienced less friction while fingering the strings than would be encountered with conventional strings without covers. This allowed for far more comfortable play over a longer period of time. With prolonged playing of the inventive strings over a period of weeks, it was observed that calluses that form on the musician's fingering hand actually diminished (probably from the reduced abrasion encountered with the inventive strings).

Another significant improvement observed was that extraneous noise ("squeak") from playing the inventive strings virtually disappeared as compared to conventional strings without covers. This allowed for faster fingering techniques without "squeaking" during note changes, greater comfort, and less playing fatigue since fingers do not have to completely separate from the strings when changing position.

Since the degree of enhancement or attenuation of string sound was observed to vary using different types of covers on different types of strings, it may be beneficial to employ different polymeric covers on different string types in a set of strings in order to mix and match sound qualities.

Experiment

Initial testing of the strings of the present invention revealed that partially covered strings exhibited slightly incorrect intonation when they are played along their length, in particular, when played at the higher frets, such as the 9th and 12th frets. It is theorized that a uniform mass per unit length of the string may be necessary for proper intonation for all notes played.

To test this theory, three string conditions were characterized as described in Table 3. A series of 0.046 in. (1.17 mm) diameter "E" bronze wound guitar strings manufactured by S.I.T. of Akron, Ohio, were selected for sound measurement. A new string was used in each sample. All strings were individually installed on a GIBSON EPIPHONE acoustic guitar and tuned to the fundamental "E" note. The different notes played by hand were monitored by a KORG model DTR-1 TONE WORKS tuner manufactured by Korg, Japan. A minus value (cents) denotes a flat note and a plus value denotes a sharp note.

Sample A

The first "E" string tested was unmodified as received in the package.

Sample B

Using a gram scale, the weight of the second "E" string was determined to be 7.20 g. The string was then covered with ePTFE film having a continuous coating of FEP on one surface. The ePTFE had a fibril length of about 50 microns, and a bulk density of about 0.35 g/cc. The film was applied in a tape wrap configuration with the FEP-coated surface down against the wire and with approximately 50% overlap at approximately 30° from perpendicular to the string longitudinal axis. Two layers were applied in the same direction. Only the portion of the string directly over the fret board was covered (approximately 60% of the string length). The string was placed under tension and heated to 345° C., in a convection oven set at 375° C. The string was removed from the oven when the surface of the string reached 345° C. as determined by a thermocouple attached to the exposed metal string surface and monitored by a readout. After cooling, the string was weighed again and determined to weigh 7.46 g. The covering weight was therefore 0.26 g. Testing was performed as described above.

Sample C

The third "E" string was selected and weighed as in Sample B. The string was very similar to Sample B, with a weight of 7.29 g. A covering weighing 0.26 g was also used for this sample. The metal wound string was reduced in mass by an abrasive sanding in the area directly over the fret board (0.26 g over approximately 60% of the string length). Next the area of reduced mass was covered with an ePTFE covering as in Sample B. Heating was also the same as in Sample B. Testing was performed as described above and values recorded on Table 3.

Figure 16:
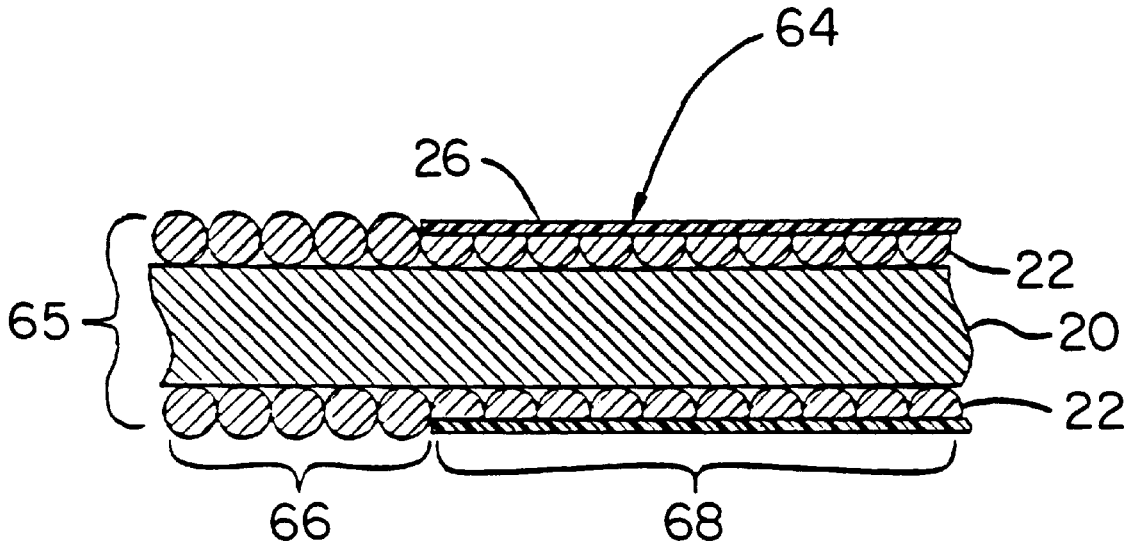
FIG. 16 is an enlarged longitudinal cross-section view of a string of the present invention having a partial cover and variable mass main string.

The modified string of Sample C is illustrated in FIG. 16. The string 64 comprises an underlying main string 65 comprising a core 20 and a winding 22, and a cover 26 mounted only over a portion of the main string 65. As can be seen, the winding 22 is at full diameter along uncovered segment 66 and is significantly reduced in diameter along cover segment 68. The diameter of the main string 65 can be reduced through any suitable manner, including by shaving, grinding, acid treatment, etc. In this example the winding 22 along cover segment 68 was reduced in mass by abrasive sanding.

Table 3 illustrates the changes in intonation between these three sample strings. The conventional string of Sample A demonstrated true sound up through the 7th fret, but experienced slightly flat tone at the 9th fret and greater flat tone at the 12th fret. The coated string of Sample B began demonstrating slightly sharp tone at the 7th fret and showed a distinctly sharp tone at the 9th and 12th frets. By contrast, the improved string of Sample C demonstrated true intonation through the 9th fret and incurred only slight flat tone at the 12th fret. As can be seen, the modified string of the present invention actually demonstrated truer intonation than the conventional uncoated string across the entire fret board.

Based on this test, uniform mass/unit length of guitar strings may be desirable for correct intonation. As is set forth below, this condition can be achieved for a string having a covering over only a portion of its length through a number of various options, including providing a variable pitch winding on wound guitar strings, i.e., spacing the individual wraps further apart under the area of covering; reducing the mass of the windings in the intended area of the covering by grinding or other methods; and/or by increasing the mass of the strings along the segment that is uncovered.

Figure 17:
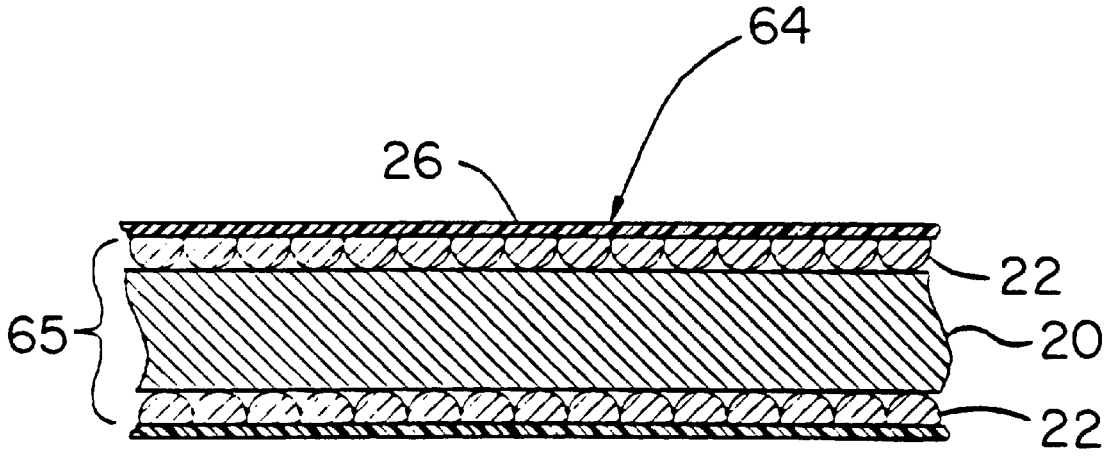
FIG. 17 is an enlarged longitudinal cross-section view of a string of the present invention having a full cover and reduced main string mass along the length of the cover.

Another embodiment of the present invention is shown in FIG. 17. In this instance the string 64 comprises a main string 65 that has been reduced in diameter along its entire length. This is again accomplished by grinding, shaving off, or otherwise removing a portion of the winding 22 of the string. The main string 65 is then coated along its entire length with a cover 26.

Figure 18:
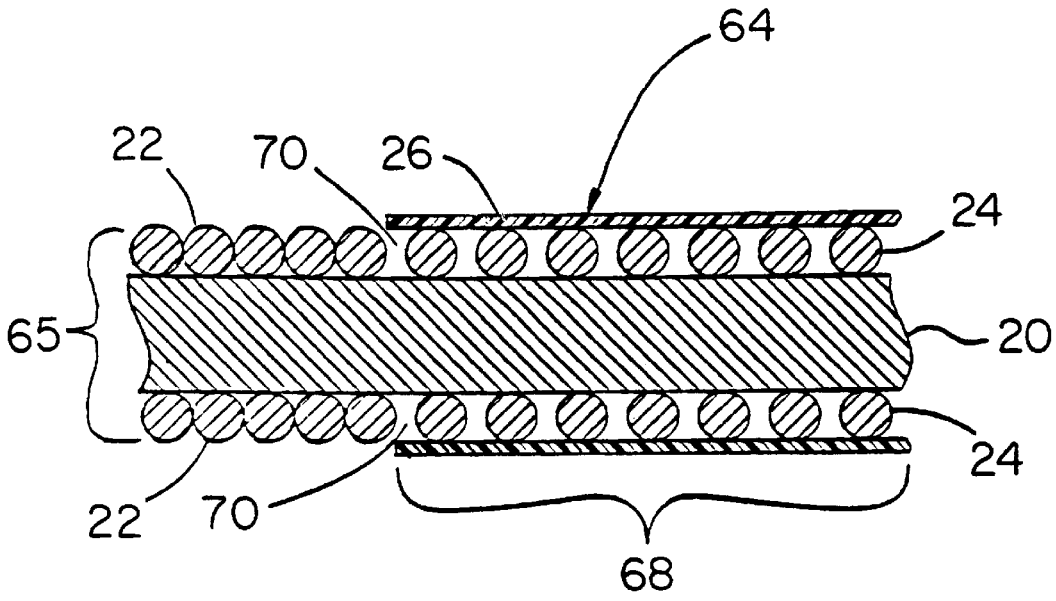
FIG. 18 is an enlarged longitudinal cross-section view of a string of the present invention having a partial cover and a modified winding on the main string to reduce main string mass beneath the cover.

In addition to removing a portion of the main string 65 to adjust for cover mass, there are a number of other options to achieve a similar functional result. FIG. 18 illustrates a string 64 of the present invention where the winding 22 has been intentionally separated along the covered segment 68. This separation leaves gaps 70 between the individual wraps 24, and accordingly reduces the mass of the string in that area. This can be accomplished during the initial underlying string 65 construction or can be performed by altering the windings 22 following string formation. In either instance, the separation of the windings 22 should be such that the reduction in the mass of the underlying string along the covered segment 68 is approximately equal to the additional mass added by the cover 26.

Figure 19:
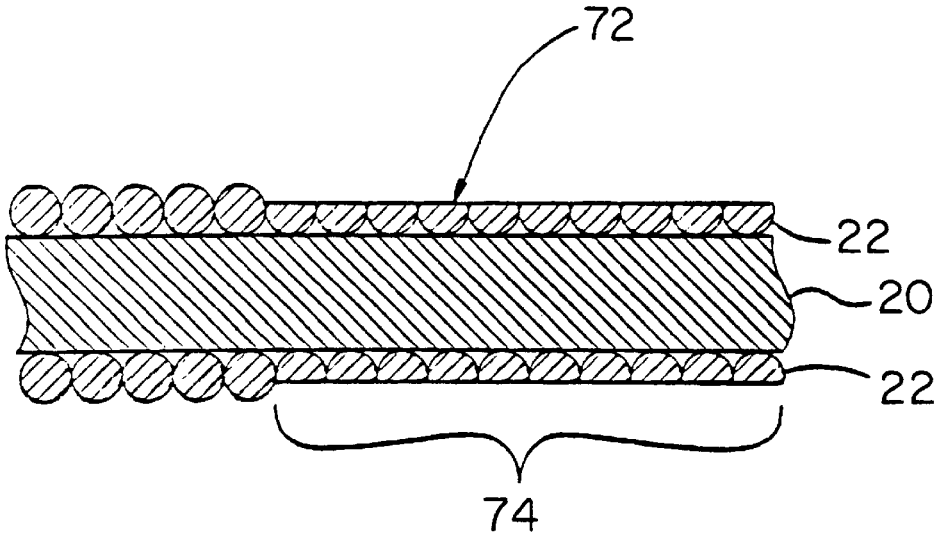
FIG. 19 is an enlarged longitudinal cross-section view of an uncovered string having variable mass along its length.

FIG. 19 illustrates a precursor string 72 to the partially covered string of FIG. 16. It is contemplated that even uncovered this string, having a variable mass along its length, may have a number of unique uses. For instance, the segment of the string with reduced mass 74 presents a flatter profile, which may be more comfortable to play than a conventional wound string.

Figure 20:
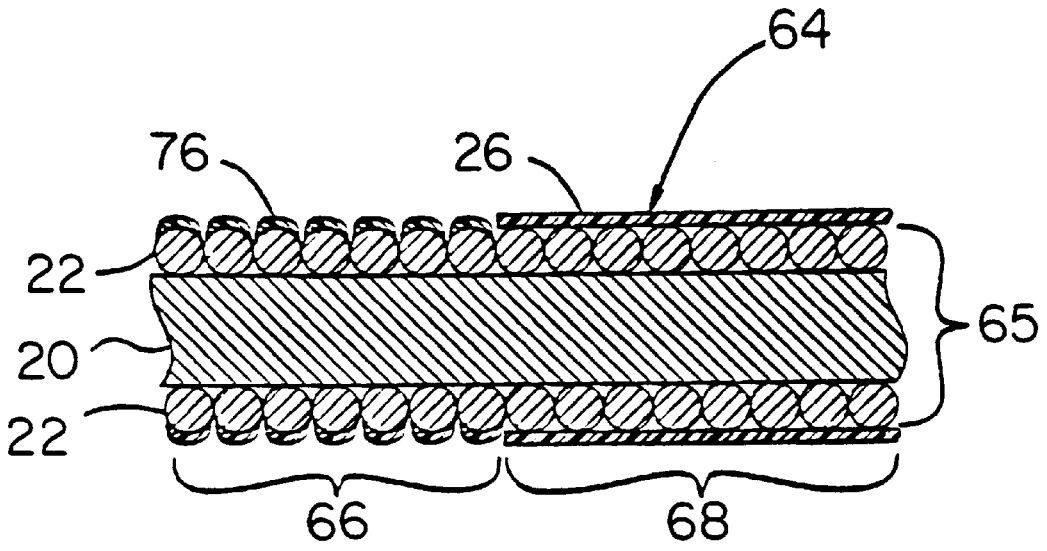
FIG. 20 is an enlarged longitudinal cross-section view of a string of the present invention having a partial cover and additional string mass added to a portion of the main string that is not covered.

Still another approach to the present invention is shown in FIG. 20. This string 64 employs a conventional main string 65. In order to equalize the mass along the string, however, an equalization coating 76 is applied over the uncovered segment 66 of the string. Again, this additional coating should be approximately equal in mass to the mass of the cover 26. The equalization coating 76 may comprise any suitable material, such as adhesive (e.g., FEP, PFA, etc.), metal plating, a further winding of metal or plastic or the like, a sleeve of additional material, etc. Since the purpose of coating 76 is to equalize the mass along the string by compensating for the mass of covering 26, it is probably desirable that this coating will have improved abrasion resistance or other properties that may make it more suitable for strumming of the instrument along the uncovered segment 66. Particularly, preferred in this regard would be an equalization coating 76 such as metal plating. It should be recognized that the equalization coating 76 should be applied in such a manner that movement between the windings 22 of the string is not diminished.

Figure 21:
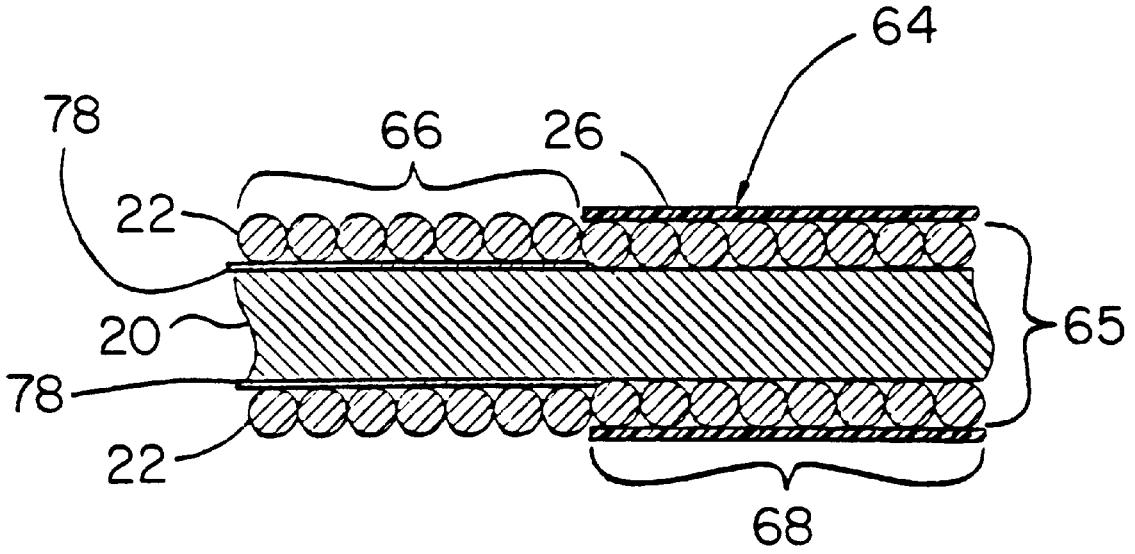
FIG. 21 is an enlarged longitudinal cross-section view of a string of the present invention having a partial cover and another embodiment of additional string mass added to the portion of the main string that is not covered.

FIG. 21 shows yet another approach to construction of a string 64 of the present invention. In this instance, additional material 78 is placed under the windings 22 along the uncovered segment 66. This additional material, such as a thin gauge wire or the like, provides mass approximately equal to that of the cover 26 along the covered segment 68.

Figure 22:
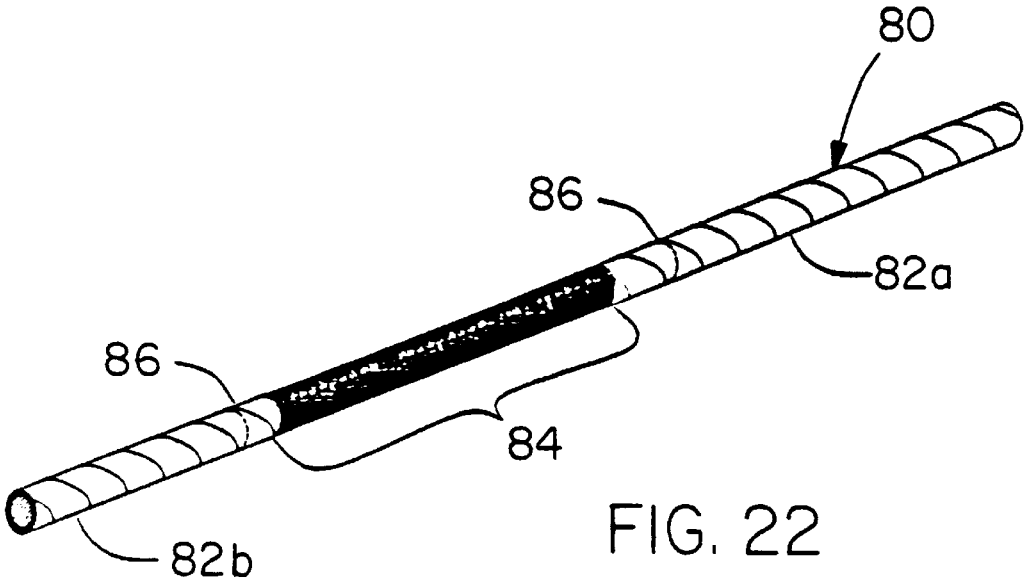
FIG. 22 is an isometric view of yet another embodiment of a covered string of the present invention, in which a portion of the string is left uncovered only in that portion of the string where the string is strummed.

It has been recognized that coating the entire length of a string can lead to somewhat unsightly shredding of the covering in areas of high abrasion, and only covering a portion of the length of the string can lead to incorrect intonation. FIG. 22 shows yet another approach to constructing an improved string 80 of the present invention. In this instance, the string 80 has a discontinuous cover 82*a*, 82*b*, leaving a short uncovered segment 84 approximately corresponding to the area where high abrasion will occur on the string during use (e.g., on a guitar this would be the 8–10 cm segment where the string is fingered or picked during play). The uncovered segment should be as short as possible to minimize incorrect intonation.

The discontinuous cover 82*a*, 82*b* may be applied through any appropriate means, including by having a discontinuous wrap of the cover 82 around the underlying string or by removing the cover from the string after construction. Additionally, one or more score lines 86 or other means can be provided on the cover to allow portions of the cover to be quickly and easily removed by the musician at the desired location before or after abrasion to the cover has occurred.

Figure 23:
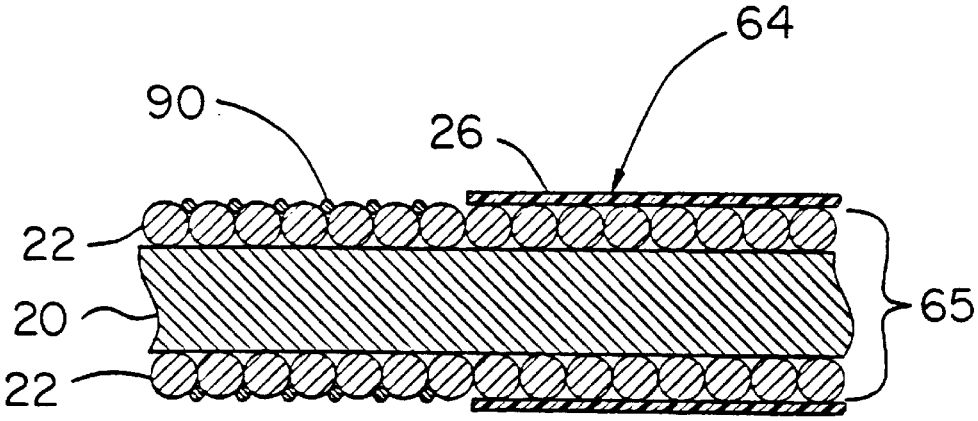
FIG. 23 is an enlarged longitudinal cross-section view of a string of the present invention having a partial cover and still another embodiment of additional string mass added to the portion of the main string that is not covered.

FIG. 23 illustrates an enlarged cross section of an alternative embodiment of the present invention wherein the main string 65 is provided with an additional winding 90 of small gauge wire around the outer surface of winding 22 which is provided only in the uncovered portion of the string to compensate for the mass of the cover 26 in the covered portion of the string.

Figure 24:
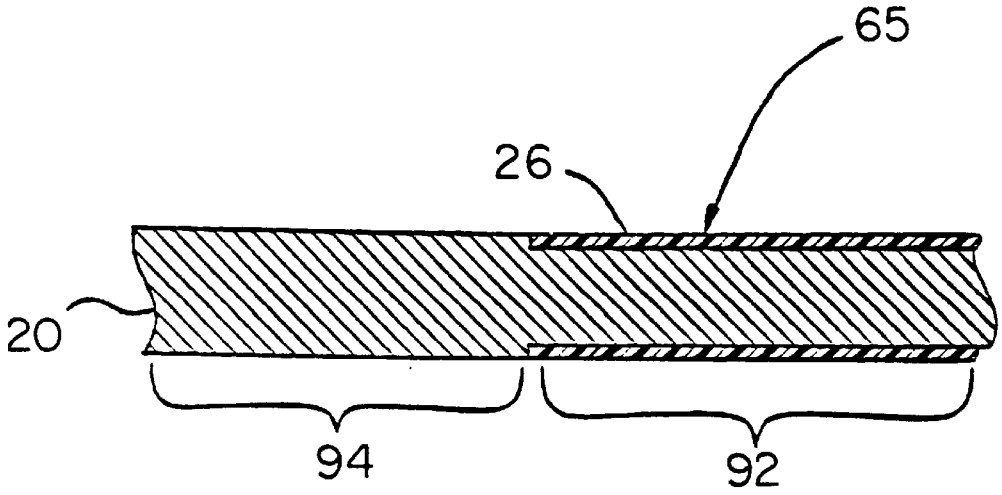
FIG. 24 is an enlarged longitudinal cross-section view of a string of the present invention having a partial cover and another embodiment of string mass being subtracted from the portion of the main string that is covered.

FIG. 24 illustrates still another alternative wherein a straight or non-wound main string 20 (i.e., a string without an outer winding) is made to have a smaller diameter and consequent lighter mass along covered portion 92 than along uncovered portion 94. Such a non-wound string having a cover over only a portion of its length and made so as to have a consistent mass per unit length when the mass of the cover is included in the total mass, is expected to have many of the advantages described previously.

Figure 25:
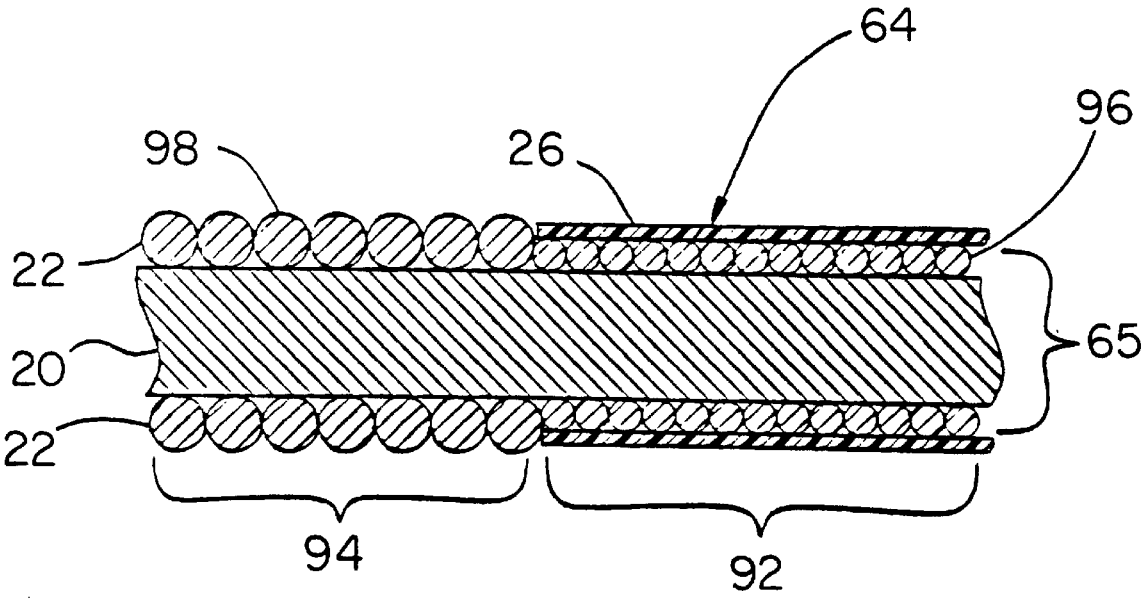

Still another method of string mass equalization is shown in FIG. 25. In this instance, the covered portion 92 of the length of the string is provided with a winding 96 that is of smaller diameter and of less mass than the winding 98 of the uncovered portion 94. Such a construction obviates the need to otherwise modify the mass of a precursor string by means such as plating, grinding, etc. While it is anticipated that the string shown in FIG. 25 is made by using two separate wires of different diameters for winding the two different portions, it may be possible to use a single continuous length of wire having different diameters along the respective first and second portions of its length.

Figure 26:
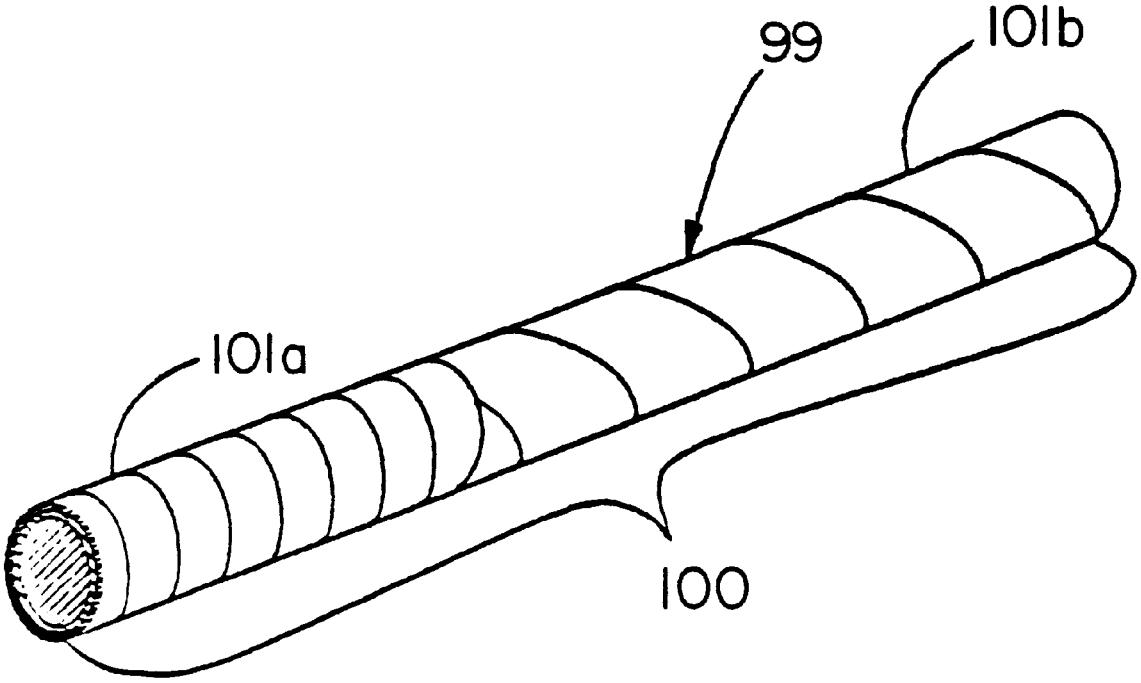
FIG. 26 is an enlarged perspective view of a string of the present invention having a two angle wrap construction.

FIG. 26 illustrates yet another approach to constructing an improved string 99 of the present invention. In this instance the covering 100 is applied in the form of a wrapping using two different wrap angles 101A and 101B on two different portions of the same string.

Example 12

This example was made from a D'Addario Phosphorus Bronze 1.07 mm (0.042 in.) wound guitar string. The string was covered with ePTFE film provided with a continuous coating of FEP adhesive as described in Example 1. The film was applied in a tape wrap configuration with a film width of about 3.48 mm (0.137 in.) in a helical overlap of about 1.72 mm (0.068 in.) and at approximately 31 degrees from perpendicular to the string longitudinal axis. The film was also applied in one direction and over the entire playing area of the string.

The string was then placed in an oven set at 365° C. for three minutes. The convection oven used for this example was constructed of a vertically-oriented metallic tube, closed at the top and open at the bottom. The string was placed into the tubular oven from the bottom while hanging from a loading device. The oven was also supplied with an inert atmosphere of reduced oxygen content. The displacement gas was nitrogen and introduced at the top closed end of the oven. Concentration of the gas was tested at the bottom of the oven by extinguishing a flame supplied by a butane lighter. The resulting inventive string showed very little oxidation and discoloration.

Example 13

This example was made from two guitar strings identical to the string described in Example 12. The purpose of this example was a side-by-side visual comparison of a string heated in an atmosphere of reduced oxygen and a string heated in a convection air oven without a modified atmosphere. The first string was heated in the oven described in Example 12 for three minutes at 365° C. The second string (attached at both ends on a loading device) was heated also for three minutes in an identical oven set at 365° C. The tubular heating chamber was placed in a horizontal position and had no atmosphere modification. Side-by-side visual comparison showed a distinct contrast in appearance. The string heated in the modified atmosphere was as described in Example 12 showing little oxidation or discoloration while the string from the non-modified atmosphere was oxidized and discolored.

As should be appreciated from the above description, there are many ways that the strings of the present invention can be modified to provide variable mass per unit length on the main string so as to compensate for the additional mass provided by a partial cover of the present invention. The foregoing embodiments of such variable mass per unit length main strings should serve as some examples of how the present invention may be practiced, but the present invention is not intended to be limited just to these examples. Accordingly, it is contemplated that the present invention encompasses any string that has a variable mass per unit length along different segments of the string (that is, strings that have one mass per unit length along one segment of the string and a different mass per unit length along another segment of the string).

While particular embodiments of the present invention have been illustrated and described herein, the present invention should not be limited to such illustrations and descriptions. It should be apparent that changes and modifications may be incorporated and embodied as part of the present invention within the scope of the following claims.

TABLE 1

| | | First ¼-Second Response (of Eight ¼-sec. intervals recorded) | | | | | |
|---|---|---|---|---|---|---|---|
| | | Column A D string (148 Hz) | | Column B A string (108 Hz) | | Column C E string (84 Hz) | |
| Example # | Construction | Harmonic | Intensity dB | Harmonic | Intensity dB | Harmonic | Intensity dB |
| 1 | 3 wrap ePTFE | 5 | +7 | 8 | +9 | 4 | +3 |
| | | 6 | −4 | 9 | +7 | 9 | +4 |
| | | 8 | +6 | | none < 0 | | none < 0 |
| | | 9 | −5 | | | | |

TABLE 1-continued

| | | First ¼-Second Response (of Eight ¼-sec. intervals recorded) | | | | | |
|---|---|---|---|---|---|---|---|
| | | Column A D string (148 Hz) | | Column B A string (108 Hz) | | Column C E string (84 Hz) | |
| Example # | Construction | Harmonic | Intensity dB | Harmonic | Intensity dB | Harmonic | Intensity dB |
| 2 | ePTFE no adhesive | N/A | | N/A | | 5 | +10 |
| | | | | | | 8 | +13 |
| | | | | | | 12 | +10 |
| 3 | TFE shrink tube (Zeus) | 3 | +5 | N/A | | 5 | +22 |
| | | 4 | +11 | | | 7 | +21 |
| | | 5 | +13 | | | 8 | +11 |
| | | 8 | −3 | | | 11 | +11 |
| | | 9 | +5 | | | | none < 0 |
| | | 10 | +11 | | | | |
| 4 | TFE tube (loose) | N/A | | 7 | −32 | N/A | |
| | | | | 8 | −42 | | |
| | | | | 9 | −40 | | |
| 5 | Vinyl electrical tape | N/A | | N/A | | 5 | +11 |
| | | | | | | 6 | −34 |
| | | | | | | 8 | +7 |
| | | | | | | 9 | −8 |
| 6 | Porous UHMWPE | N/A | | N/A | | 5 | +4 |
| | | | | | | 6 | −7 |
| | | | | | | 8 | +10 |
| | | | | | | 9 | −4 |
| 7 | Fender Bass A String | N/A | | 12 | −6 | N/A | |
| Sample 1 | nylon wound | | | 13 | −6 | | |
| | (commercially available product) | | | | none > 0 | | |
| 7 | Fender Bass A String | N/A | | 4 | +4 | N/A | |
| Sample 3 | 4 wrap ePTFE | | | 7 | +5 | | |
| | | | | 9 | −3 | | |
| | | | | 11 | +7 | | |
| | | | | 14 | +4 | | |
| 7 | Fender Bass A String | N/A | | 7 | +4 | N/A | |
| Sample 4 | 6 wrap ePTFE | | | 9 | −4 | | |
| | | | | 11 | +6 | | |
| | | | | 13 | +4 | | |

N/A = not applicable (this configuration not tested)

TABLE 2

| | | A string (54 Hz) | |
|---|---|---|---|
| Example # | Construction | Harmonic | Intensity dB |
| 7 | Fender Bass A String, | 11 | −25 |
| Sample 1 | nylon wound as | 12 | −19 |
| | purchased | 13 | −18 |
| | | 14 | −11 |
| 7 | Fender Bass A String | 2 | +5 |
| Sample 3 | 4 wrap ePTFE | 3 | +10 |
| | | 4 | +7 |
| | | 7 | +7 |
| | | 8 | −1 |
| | | 12 | −1 |
| 7 | Fender Bass A String | 2 | −3 |
| Sample 4 | 6 wrap ePTFE | 3 | +13 |
| | | 4 | −3 |
| | | 8 | +16 |
| | | 10 | +12 |
| | | 12 | +13 |
| | | 14 | +16 |

TABLE 3

| | Intonation Test | | |
|---|---|---|---|
| | E string (84 Hz) | | |
| | Sample #A | Sample #B | Sample #C |
| String Mass (less cover) | 7.26 g | 7.20 g | 7.03 g |
| Covering | 0 g | .26 g | .26 g |
| Mass Total mass | 7.26 g | 7.46 g | 7.29 g |
| | INTONATION | | |
| 3rd Fret | 0 cents | 0 cents | 0 cents |
| 5th Fret | 0 cents | 0 cents | 0 cents |
| 7th Fret | 0 cents | +5 cents | 0 cents |
| 9th Fret | −5 cents | +10 cents | 0 cents |
| 12th Fret | −10 cents | +10 cents | −5 cents |

Note:
A plus value indicates note is sharp.
A minus value indicates note is flat.

The invention claimed is:

1. A musical instrument string made through a process comprising providing a wound string comprising a metal;

placing a cover over at least a portion of the wound metal string to form a covered string;

heating the covered wound string in an environment having a sufficiently low concentration of oxygen so as not to support combustion so as to produce a covered wound musical instrument string with little oxidation and discolorization under the cover.

2. The musical instrument string made in accordance with claim 1 that further comprises forming the cover with at least one layer of polymer material.

3. The musical instrument string made in accordance with claim 2 that further comprises covering the string with a polymer material comprising polytetrafluoroethylene.

4. The musical instrument string made in accordance with claim 3 that further comprises providing the polytetrafluoroethylene as a polytetrafluoroethylene having a microstructure of oriented fibrils.

5. The musical instrument string made in accordance with claim 1 that further comprises heating the string in an environment having increased concentration of inert gas.

6. The musical instrument string made in accordance with claim 5 that further comprises providing nitrogen as at least a portion of the inert gas.

7. The musical instrument string made in accordance with claim 1 that further comprises forming the cover with at least one layer of polymer material.

8. The musical instrument string made in accordance with claim 7 that further comprises covering the string with a polymer material comprising polytetrafluoroethylene.

9. The musical instrument string made in accordance with claim 8 that further comprises providing the polytetrafluoroethylene as a polytetrafluoroethylene having a microstructure of oriented fibrils.

10. The musical instrument string made in accordance with claim 1 that further comprises heating the covered string in the environment including an inert gas.

11. The musical instrument string made in accordance with claim 1 that further comprises providing a cover that is substantially non-dampening.

12. The musical instrument string made in accordance with claim 1 that further comprises the string having a longitudinal axis and providing a cover that is deformable along the longitudinal axis of the string.

13. The musical instrument string made in accordance with claim 1 that further comprises heating the string in an environment of inert gas.

14. A musical instrument string made through the process comprising providing a string having a length and comprising a metal;

covering the string with a polymeric cover to form a covered string; and heating the covered string in an environment having a sufficiently low concentration of oxygen so as not to support combustion so as to produce a musical instrument string along its length following heating.

15. The musical instrument string made in accordance with claim 14 that further comprises providing nitrogen as at least a portion of the inert gas.

16. The musical instrument string made in accordance with claim 14 that further comprises providing a cover over only a portion of the string prior to heating and whereby the musical instrument string has a surface with little oxidation and discolorization on an uncovered portion and under the cover following heating.

17. The musical instrument string made in accordance with claim 16 that further comprises providing a cover that is substantially non-dampening.

18. The musical instrument string made in accordance with claim 16 that further comprises the string having a longitudinal axis and providing a cover that is deformable along the longitudinal axis of the string.

19. The musical instrument string made in accordance with claim 16 that further comprises heating the string and cover in an environment having a sufficiently low concentration of oxygen so as not to support combustion.

* * * * *